US011053699B2

(12) United States Patent
Puchner et al.

(10) Patent No.: US 11,053,699 B2
(45) Date of Patent: Jul. 6, 2021

(54) CLIMBING SHOE, SAFETY SCREEN SUPPORT SYSTEM AND SAFETY SCREEN SYSTEM

(71) Applicant: DOKA GMBH, Amstetten (AT)

(72) Inventors: Andreas Puchner, Egenhofen (DE); Stefan Daubner, Fuerstenfeldbruck (DE)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 15/795,858

(22) Filed: Oct. 27, 2017

(65) Prior Publication Data

US 2019/0127999 A1 May 2, 2019

(51) Int. Cl.
*E04G 21/32* (2006.01)
*E04G 1/15* (2006.01)
*E04G 3/24* (2006.01)

(52) U.S. Cl.
CPC ..... *E04G 21/3223* (2013.01); *E04G 21/3247* (2013.01); *E04G 3/243* (2013.01); *E04G 2001/157* (2013.01)

(58) Field of Classification Search
CPC ... E04G 21/3223; E04G 21/3247; E04G 5/06; E04G 5/56; E04G 2003/286; E04G 11/24; E04G 11/28; E04G 11/30
See application file for complete search history.

(56) References Cited

U.S. PATENT DOCUMENTS 3,784,195 A * 1/1974 Johnson ..... A63B 23/00 482/123
4,892,169 A * 1/1990 Duncan ..... E04G 21/3223 182/138
4,955,584 A * 9/1990 Anderson ..... A63B 27/00 182/133
5,992,565 A * 11/1999 Lingen ..... B66B 9/16 182/141
8,714,512 B2 * 5/2014 Schwoerer ..... E04G 11/28 249/20
9,033,106 B2 * 5/2015 Blinn ..... E04G 21/3247 182/139
9,175,487 B2 * 11/2015 Iturbe Beristain ..... E04G 21/3219

(Continued)

FOREIGN PATENT DOCUMENTS

CA 2973150 A1 * 1/2018 ..... E04G 21/3247
DE 2814930 A1 * 10/1979 ..... E04G 11/28
EP 2789772 A1 * 10/2014 ..... E04G 21/3223
EP 2995749 A1 * 3/2016 ..... F16C 7/04
EP 3196383 A1 7/2017

(Continued)

OTHER PUBLICATIONS

IP Australia, Examination Report Issued in Application No. 2018356457, dated Jan. 20, 2020, 3 pages.

*Primary Examiner* — Daniel P Cahn
*Assistant Examiner* — Candace L Bradford
(74) *Attorney, Agent, or Firm* — McCoy Russell LLP

(57) ABSTRACT

The present disclosure relates to a climbing shoe for a climbing safety screen, comprising: a support member for engaging a climbing rail of the climbing safety screen; a fork member with a first flange and a second flange; an outer member pivotally connected to the first flange and second flange about a transverse axis; an inner member mounted to the outer member and pivotable about a longitudinal axis with respect to the outer member.

16 Claims, 28 Drawing Sheets

(56) References Cited

U.S. PATENT DOCUMENTS

| | | | | |
|---|---|---|---|---|
| 2009/0173574 | A1* | 7/2009 | Hobmeier | E04G 11/28 182/82 |
| 2012/0247870 | A1* | 10/2012 | Iturbe Beristain | E04G 21/3247 182/82 |

FOREIGN PATENT DOCUMENTS

| | | | | |
|---|---|---|---|---|
| GB | 1572918 | A * | 8/1980 | E04G 21/3223 |
| GB | 2529470 | A | 2/2016 | |
| WO | 2007000135 | A1 | 1/2007 | |

* cited by examiner

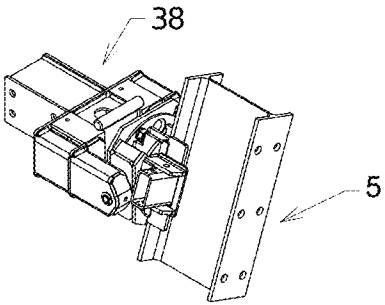
Fig.55
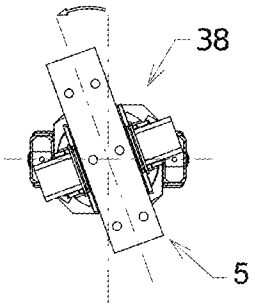
Fig.56
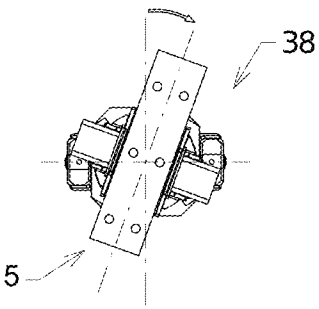
Fig.57
Fig.58
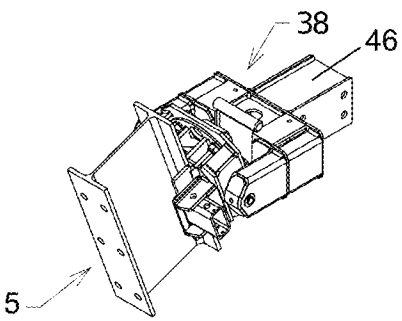
Fig.59
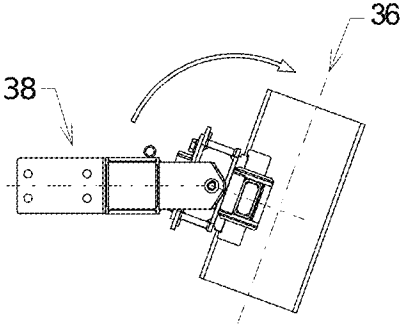
Fig.60
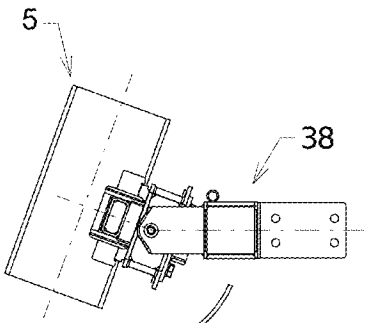
Fig.61
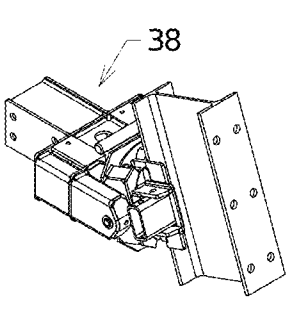
Fig.62
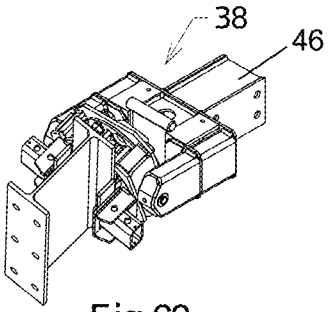
Fig.63
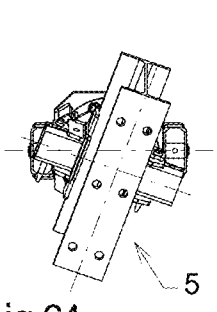
Fig.64
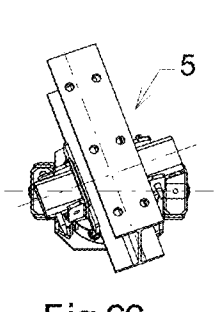
Fig.65
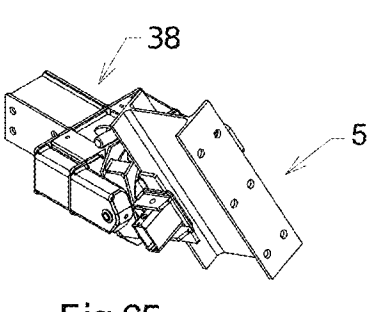
Fig.66

CLIMBING SHOE, SAFETY SCREEN SUPPORT SYSTEM AND SAFETY SCREEN SYSTEM

FIELD OF THE PRESENT DISCLOSURE

The present disclosure generally relates to a climbing shoe, a safety screen support system and a safety screen system for use in the formation of a concrete structure, in particular for safeguarding workers in the construction of a high-rise building.

DESCRIPTION OF THE RELATED ART AND OBJECT OF THE PRESENT DISCLOSURE

As is known in the prior art (see for example EP 3 196 383 A1 or GB 2,529,470), when building a construction which has a central structure formed by poured concrete, a climbing screen system may be used to enclose the perimeter of at least a part of the construction. The climbing screen system typically includes a plurality of safety screens arranged adjacent one another to safeguard workers from adverse weather conditions and to ensure a safe working environment. As each floor of the construction is formed, the climbing screen is moved up the construction, exposing the previously formed floors beneath. These climbing screens typically comprise two climbing rails attached to the back side of the safety screen. The climbing rails are engaged by climbing floor guides and supports, so-called climbing shoes, that project outwardly from the edges of the floors. The climbing shoes allow for translation of the climbing screen along the construction and are further operable to lock the position of the climbing screen adjacent the floors during use.

The prior art safety screens and their supports on the floors are typically designed for the formation of rectangular structures. In recent times, however, high-rise buildings with a wide range of shapes have been developed.

It is an object of this present disclosure to improve on the floor supports and guides for safety screes available in the prior art. The present disclosure particularly aims at providing a climbing shoe for supporting a safety screen in the construction of buildings with complex shapes.

SUMMARY OF THE PRESENT DISCLOSURE

In a preferred embodiment, the present disclosure provides for a climbing shoe for a climbing safety screen, comprising: a support member for engaging a climbing rail of the climbing safety screen; a fork member with a first flange and a second flange; an outer member pivotally connected to the first flange and second flange about a transverse axis; and an inner member mounted to the outer member and pivotable about a longitudinal axis with respect to the outer member.

In this construction, the climbing shoe has an outer member pivotally connected to the first and second flange of the fork member, respectively, and an inner member pivotally connected to the outer member. The outer member is pivotable about a transverse axis, which, in use, may extend parallel to a floor edge extending at the perimeter of a floor so as to allow for a backward or forward tilt of the safety screen supported on the climbing shoe. The inner member is pivotable about a longitudinal axis with respect to the outer member, the longitudinal axis preferably extending perpendicularly to the floor edge. Preferably, the first and second flange of the fork member extend parallel to the longitudinal pivot axis of the inner member. In use, an engagement member of a longitudinal carrier attached to a back side of a safety screen is supported on the support member of the climbing shoe. The support member is arranged on the inner member of the climbing shoe so that a pivoting of the outer member of the climbing shoe about the transverse axis is transferred into a backward or forward tilt of the safety screen. In the same fashion, a pivoting of the inner member of the climbing shoe about the longitudinal axis is transferred into a sideward tilt of the safety screen. It is an advantage of this construction that the sideward tilt of the safety screen can be adjusted simultaneously with the backward or forward tilt of the safety screen. In use, the safety screen may be arranged in accordance with the geometry of the concrete structure to be erected. The construction disclosed herein is particularly advantageous if two adjacent floors of the building under construction are not perfectly superimposed, but are offset from one another.

For the purpose of this disclosure, all directions and positions, such as "upwards", "downwards", "upper", "lower", "vertical", "horizontal", are given with respect to an intended use of the climbing shoe in which the outer member and the inner member are each arranged in a central (horizontal) position for a vertical arrangement of the safety screen.

In a preferred embodiment, the outer member has a first sliding support surface and the inner member has a first sliding surface, the first sliding support surface of the outer member being arranged for a sliding support of the first sliding surface of the inner member. In this embodiment, the sideward tilting of the inner member is supported by a sliding movement of the first sliding surface of the inner member against the correspondingly shaped first sliding support surface of the outer member. This construction results in a particularly strong support of the safety screen.

In a preferred embodiment, the inner member pivots about a virtual longitudinal axis defined by the arrangement of the first sliding support surface of the outer member and the first sliding surface of the inner member. In this embodiment, no pivot pin is arranged between the outer member and the inner member.

In a preferred embodiment, the first sliding support surface of the outer member and the first sliding surface of the inner member are circular in cross-section. In this way, the inner member may rotate over a wide range of tilting angles against the outer member for adjusting the sideward tilt of the inner member.

In a preferred embodiment, the outer member has a first circular opening defining the first sliding support surface. Preferably, a ratio between a diameter of the first circular opening and an extension of the first sliding support surface in direction of the longitudinal axis is at least 3:1, preferably more than 5:1. It is also preferred that the longitudinal axis extends through a center of the first circular opening. In this way, the first sliding support surface is axially symmetric about the longitudinal axis.

In a preferred embodiment, the inner member has a first disk fitting into the first circular opening of the outer member. By choosing appropriate dimensions of the first disk of the inner member and the first circular opening of the outer member, the climbing shoe is arranged for withstanding high loads without the danger of getting jammed. As a further advantage, the extension of the first disk in direction of the longitudinal axis (i.e. its wall thickness) is smaller than, in particular by a multitude smaller than, an extension of the first disk in direction perpendicular to the longitudinal axis. In contrast to this, a conventional pivot pin is elongate in direction of the longitudinal axis. Thus, the gliding support of the first disk in the first circular opening of the outer member ensures that there is sufficient space in direction of the longitudinal axis for the arrangement of an engaging member of a longitudinal carrier that may be supported on the support member of the climbing shoe.

An outer diameter of the first disk may extend above a top surface of the first and second flange and/or below a bottom surface of the first and second flange.

Preferably, the first circular opening has a diameter of at least 15 cm, more preferably of at least 20 cm.

In a preferred embodiment, the inner member has an offset rim adjacent the first disk, the offset rim overlapping in radial direction of the first disk with the outer member. Preferably, the first circular opening is formed in a first plate of the outer member. In this case, the offset rim of the inner member is arranged adjacent an outer surface of the first plate of the outer member.

In a preferred embodiment, the outer member has a second circular opening spaced from the first circular opening in direction of the longitudinal axis, the second circular opening defining a second sliding support surface for a sliding support of a second sliding surface of the inner member. Preferably, the support member is arranged between the first and second circular opening of the outer member. In this case, the loads resulting from the supporting of the safety screen are securely and effectively transferred into the climbing shoe. In particular, a risk of the inner member getting jammed inside the outer member is significantly reduced or eliminated.

In a preferred embodiment, the inner member has a second disk fitting into the second circular opening of the outer member. The first and second disk are spaced from one another in direction of the longitudinal axis. Thus, the first and second disk of the inner member are supported on the outer member at longitudinally spaced positions which safeguards the rotatability of the inner member against the outer member even under high loads when supporting the safety screen.

In a preferred embodiment, the second disk has an aperture for allowing the introduction of an engagement member of the climbing rail into a space between the first disk and the second disk. Preferably, the aperture extends over the full vertical extension of the second disk. In this embodiment, the second disk is formed by two semi disks.

In a preferred embodiment, the first disk and the second disk are connected by at least two webs. Preferably, the webs each have a main plane extending vertically and longitudinally (with respect to the central position of the inner member adapted for a straight arrangement of the safety screen).

In a preferred embodiment, the support member is displaceably mounted on the inner member. For this purpose, the inner member may have a guide, for example an elongated slot. In this way, the support member can be transferred from a support position for supporting an engagement member formed at a longitudinal carrier of the safety screen and a retracted position for allowing the longitudinal carrier be moved upwards. During the upwards translation of the safety screen, the engagement member of the longitudinal carrier may temporarily push the support member to the retracted position. The support member may be biased in direction of the support position by means of a spring. In this case, the longitudinal carrier may be moved upwards inside the climbing shoe and supported on the support member after completion of the upwards movement.

In a preferred embodiment, the support member is aligned with the transverse axis. This construction is particularly favorable for transferring the loads from the safety screen into the climbing shoe.

In a preferred embodiment, the support member has a pin which is arranged colinear with the transverse axis. Preferably, the longitudinal axis and the transverse axis cross at a center of the pin in its support position to achieve optimal load transfer at all angles of the safety screen. In this embodiment, the engagement member on the longitudinal carrier preferably is a hook that can be supported on the pin of the support member. This construction allows for an effective load transfer into the climbing shoe and thus into the floor of the concrete structure.

In a preferred embodiment, the longitudinal axis extends centrally between the first flange and the second flange of the fork member. This embodiment further improves the load transfer from the safety screen to the climbing shoe.

In a preferred embodiment, the support member (in the central position of the inner member) is symmetrically arranged about a vertical (middle) plane containing the longitudinal axis. This embodiment ensures a uniform load transfer into the climbing shoe.

In a preferred embodiment, a first locking and guiding member and a second locking and guiding member are mounted to the inner member, the first locking and guiding member and the second locking and guiding member being moveable, preferably in direction perpendicular to the longitudinal axis, between an outer position for inserting a climbing rail into the climbing shoe and an inner position for locking the climbing rail to the climbing shoe. Safety pins may be provided for locking the first locking and guiding member and the second locking and guiding member in their outer and/or inner position.

In a preferred embodiment, the outer member can be pivoted about the transverse axis by at least 20 degrees, more preferably by more than 30 degrees, backwards and forwards with respect to a central position of the outer member.

In a preferred embodiment, the inner member can be pivoted about the longitudinal axis by at least 20 degrees, more preferably by more than 30 degrees, in both directions with respect to a central position of the inner member.

In a preferred embodiment, the present disclosure provides for a climbing screen support system comprising: a support arm fixable to a surface adjacent an edge of a floor; and a climbing shoe connected to an end of the support arm, the climbing shoe having a support member for engaging a climbing rail of a climbing safety screen, a fork member with a first flange and a second flange, an outer member pivotally connected to the first flange and second flange about a transverse axis, an inner member mounted to the outer member and pivotable about a longitudinal axis.

In a preferred embodiment, the present disclosure further provides for a climbing screen system comprising: a support arm fixable to a surface adjacent an edge of a floor; a climbing shoe connected to an end of the support arm, the climbing shoe having a support member, a fork member with a first flange and a second flange, an outer member pivotally connected to the first flange and second flange about a transverse axis, an inner member mounted to the outer member and pivotable about a longitudinal axis; and a climbing safety screen with a climbing rail having an engagement member supported on the support member of the climbing shoe.

In a preferred embodiment, first guiding surfaces of the inner member of the climbing shoe are provided for restricting movement of the climbing rail in direction of the transverse axis and second guiding surfaces of a first locking and guiding member, a second locking and guiding member and the inner member are provided for restricting movement of the climbing rail in direction of the longitudinal axis, wherein the climbing rail is connected to the climbing shoe with a first clearance in direction of the transverse axis and a second clearance in direction of the longitudinal axis, wherein a first ratio between a vertical extension of the first guiding surfaces at the inner member and the first clearance is at least 50:1 and/or a second ratio between a vertical extension of the second guiding surfaces at the first locking and guiding member, second locking and guiding member and inner member and the second clearance is at least 50:1. For example, the vertical extension of the first and/or second guiding surfaces may be at least 150 mm, preferably more than 180 mm, e.g. 200 mm. This construction ensures that the climbing rail can be safely moved upwards inside the climbing shoe without jamming independently of the tilt of the inner member of climbing shoe. Preferably, the first and second locking and guiding members are moveably arranged on the inner member. However, in a less preferred embodiment, the first and second locking and guiding members are immovably arranged on the inner member.

Preferably, the first ratio and/or the second ratio is at least 100:1.

In a preferred embodiment, a safety screen comprises: a plurality of screen members vertically arranged above one another; two longitudinal carriers pivotally connected to the screen members, wherein in a first operating position, the longitudinal carriers extend vertically and the screen members extend horizontally, and wherein in a second operating position, the longitudinal carriers are inclined sideward from vertical and the screen members extend horizontally, offset from one another horizontally.

Thus, the longitudinal carriers are pivotable with respect to the screen members about pivot axes extending perpendicular to main planes of the screen members defining the screening surface of the safety screen. In this way, the longitudinal carriers can be pivoted sideward with respect to a floor edge in order to enclose at least a part of the perimeter of the building to be constructed. This is particularly advantageous if two floors of the building under construction are not perfectly superimposed, but are offset from one another in horizontal, lateral direction. For example, a tilt of the longitudinal carriers from vertical may be set to correspond to an angle defined by two floor edges on top of one another. When tilting the longitudinal carriers, the screen members, by means of their pivotal connections to the longitudinal carriers, are maintained in a horizontally (laterally) extending position, but are displaced laterally. Thus, in the second operating positions, the upper and lower edges of the screen members may extend horizontally while the side edges of the screen members may extend vertically, yet offset from one another in lateral direction. This results in a stepped arrangement of the side edges of the screen members. Thus, in the first and in the second operating position, the lower edge of the lowermost screen member may be arranged parallel with the floor edge of a lower floor, while the upper edge of the uppermost screen member may be arranged parallel with the floor edge of an upper floor. The construction of the safety screen disclosed herein provides for improved adjustability and adaptability, in particular when constructing or deconstructing complexly shaped buildings.

BRIEF DESCRIPTION OF THE DRAWINGS

Other objects and features of the present disclosure will become apparent from the following detailed description considered in connection with the accompanying drawings. It is to be understood, however, that the drawings are designed as an illustration only and not as a definition of the limits of the present disclosure.

FIG. 55 is a side perspective view and FIG. 56 is an end plan view of the climbing shoe of FIG. 42 with the inner member tilted sideward in a first direction.

FIG. 57 is a side perspective view and FIG. 58 is an end plan view of the climbing shoe of FIG. 42 with the inner member tilted sideward in a second, opposite direction.

FIG. 59 is a side perspective view and FIG. 60 is a side plan view of the climbing shoe of FIG. 42 with the inner member tilted backward.

FIG. 61 is a side perspective view and FIG. 62 is a side plan view of the climbing shoe of FIG. 42 with the inner member tilted forward.

FIG. 63 is a side perspective view and FIG. 64 is an end plan view of the climbing shoe of FIG. 42 with the inner member tilted backward and sideward in a first direction.

FIG. 65 is a side perspective view and FIG. 66 is an end plan view of the climbing shoe of FIG. 42 with the inner member tilted forward and sideward in a second, opposite direction.

FIGS. 1-66 are shown approximately to scale.

DETAILED DESCRIPTION OF THE DRAWINGS

Figure 1:
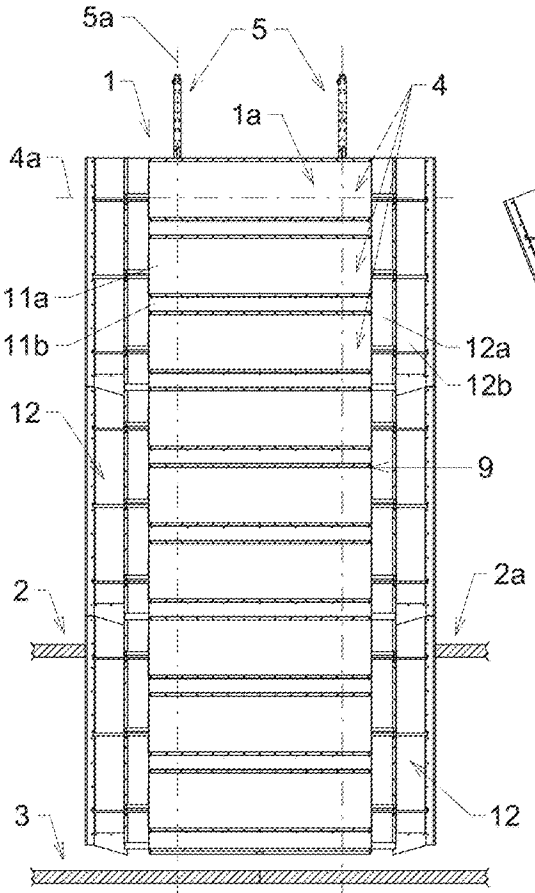
FIG. 1 is a front plan view of a safety screen for securing a floor of a concrete structure in a first operating position, wherein the safety screen has horizontal screen members, lateral screen members extending vertically and longitudinal carriers pivotally connected to the back sides of the horizontal screen members.

FIG. 1 shows a safety screen 1 for securing an outer perimeter of a floor 2 in the construction of a building 3. In an initial shown example, the safety screen 1 is a climbing safety screen (shield) 1 that is moved upwards from floor to floor. In the initial shown example, a crane may be used to lift the safety screen 1 (and a formwork not shown in the drawings) after completion of a casting step. In an alternative embodiment, the climbing screen 1 may be self-climbing. Typically, a plurality of safety screens 1 are arranged next to each other to improve the safety of workers on the floor 2.

In the initial shown example, the safety screen 1 has a plurality, preferably more than three, more preferably more than six, for example nine, screen members 4 vertically arranged on top of one another in an upright position. The screen members 4 have main (principal) planes that together define a screening plane 1*a* which shields an opening formed between edges 2*a* of two superimposed floors 2. The screen members 4 may have the same lateral extension. At the inner side of the safety screen 1 (facing the building 3) two longitudinal carriers 5 connect to the screen members 4 such that the longitudinal carriers 5 can be pivoted sideward with respect to the screen members 4 in a vertical plane extending parallel to the floor edge 2*a*.

In a first operating position (shown in FIG. 1), the longitudinal axes 5*a* of the longitudinal carriers 5 extend vertically, whereas the longitudinal axes 4*a* of the screen members 4 extend horizontally in the screening surface 1*a* of the safety screen 1.

Figure 3:
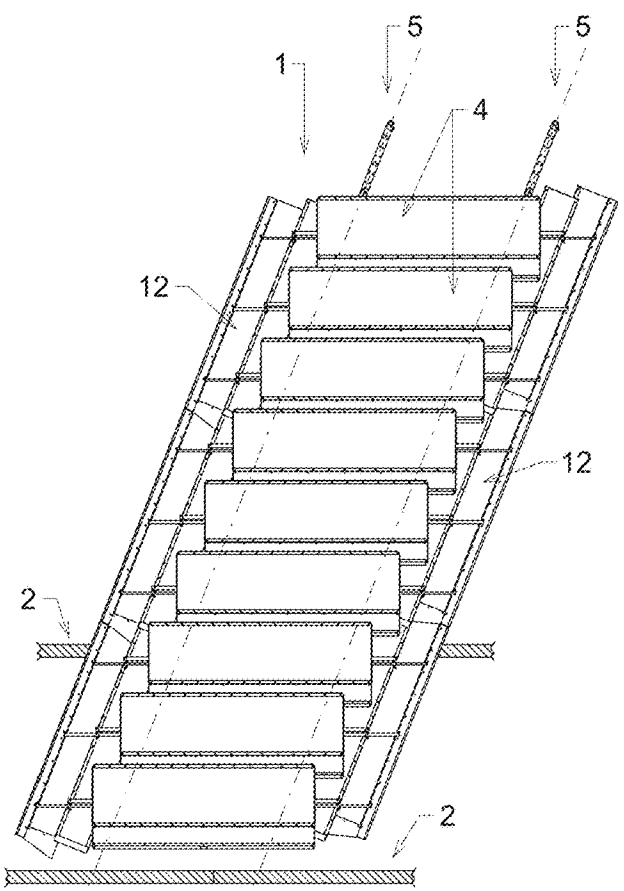
FIG. 2 and FIG. 3 are front plan views of the safety screen of FIG. 1 in a second operating position, in which the safety screen is tilted to the one side (FIG. 2) or to the other side (FIG. 3).
Figure 2:
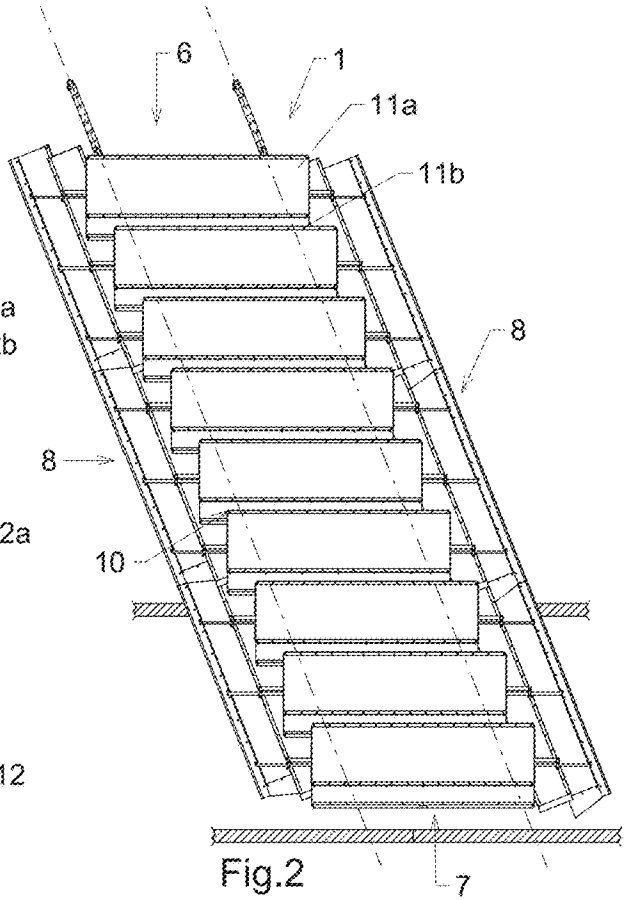

In a second operating position (shown in FIG. 2 and FIG. 3), the longitudinal carriers 5 are tilted sideward in the vertical plane extending parallel to the floor edge 2*a*. The screen members 4 are maintained in their horizontally extending position, but are arranged offset from one another horizontally in the screening plane 1*a* of the safety screen 1. For arranging the safety screen 1 in the second operating position, the longitudinal carriers 5 are pivoted about pivot axes extending perpendicularly to the screening surface 1*a* of the safety screen 1 in the one direction (see FIG. 2) or in the other direction (see FIG. 3), both with respect to the first operating position. As a result, the outer contour of the safety screen 1, in the second operating position, forms a rhomboid with a generally horizontally extending upper edge 6, a generally horizontally extending lower edge 7 and opposite side edges 8 inclined sideward from vertical (see FIG. 2). This results in a stepped arrangement of the screen members 4, in which an upper screen member 4 at one side laterally extends beyond a lower screen member 4.

In the initial shown example, the screen members 4, in the first operating position, have a first vertical overlap (illustrated by arrow 9 in FIG. 1) and, in the second operating position, have a second vertical overlap (illustrated by arrow 10 in FIG. 2), wherein the second vertical overlap is larger than the first vertical overlap. Thus, there is a continuous screening surface 1*a* in both of the first and second operating position. For allowing the vertical overlap of superimposed screen members 4, the screen members 4 each have a first screen panel 11*a* and a second screen panel 11*b*, wherein the second screen panel 11*b* is displaced with respect to the first screen panel 11*a* in direction perpendicular to the screening surface 1*a*.

In the initial shown example, the safety screen 1 further comprises two lateral screen members 12 arranged laterally of (i.e. at the sides of) the horizontal screen members 4. The lateral screen members 12 extend the screening surface 1*a* of the screen members 4 at the longitudinal sides of the safety screen 1. The lateral screen members 12 are pivotally connected to the screen members 4 such that the lateral screen members 12 in the second operating position are inclined sideward from vertical in correspondence with the longitudinal carriers 5. The longitudinal axes of the lateral screen members 12 preferably are parallel to the longitudinal axes of the longitudinal carriers 5 in both of the first and second operating position.

Figure 12:
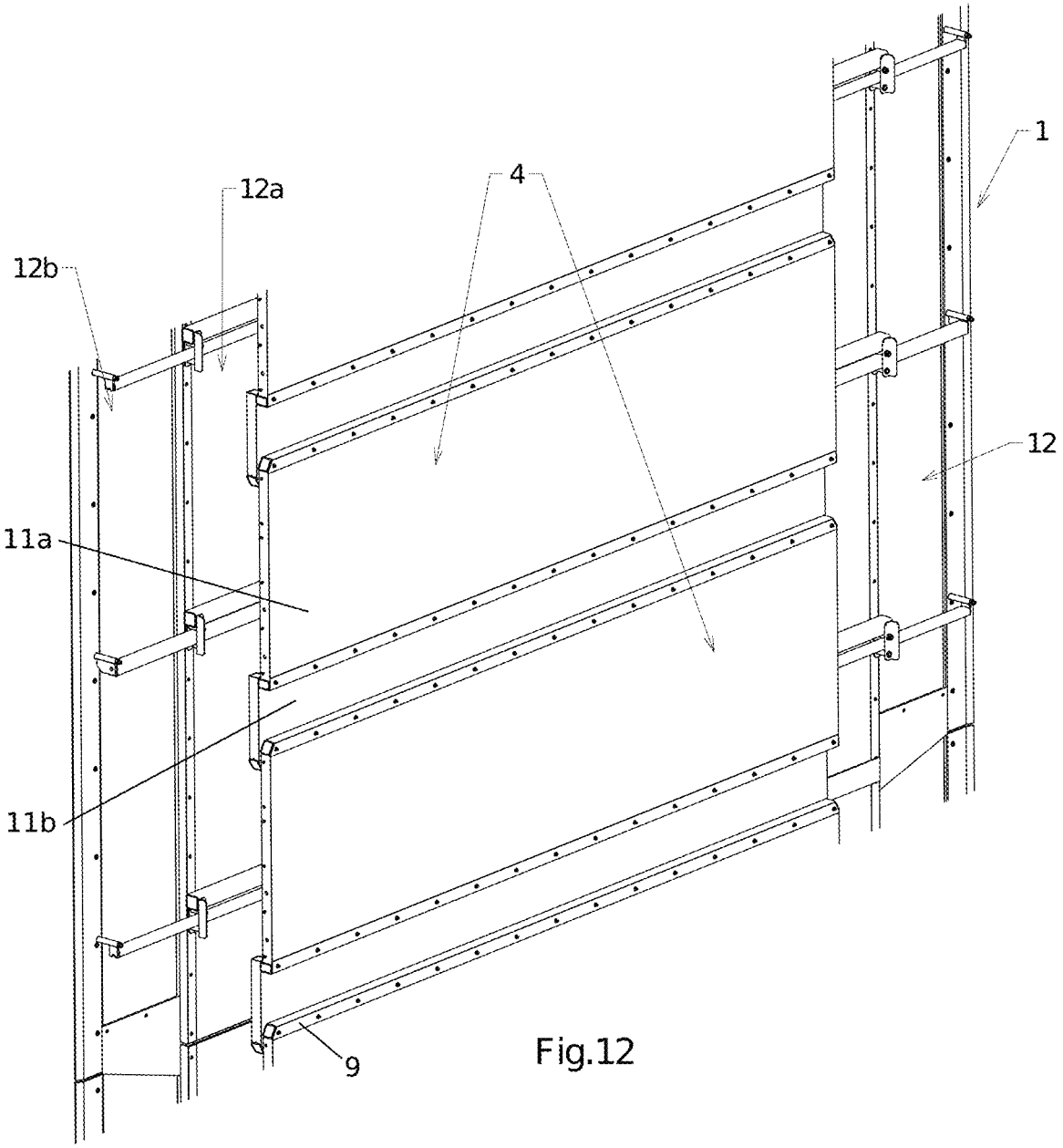
FIG. 12 is a detailed angled plan view of a portion of the safety screen of FIG. 1 showing lateral screen members in a fully extended state.
Figure 13:
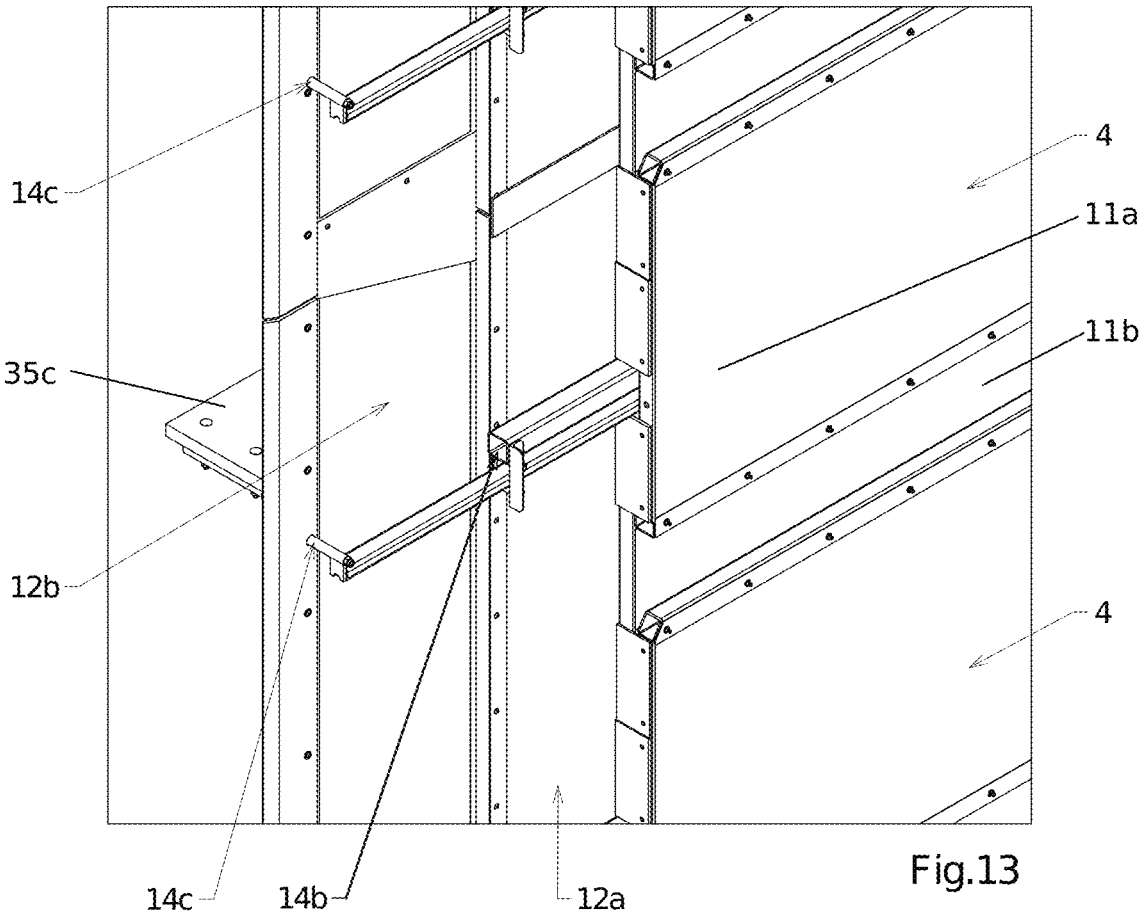
FIG. 13 is a detailed side perspective view of the safety screen of FIG. 12 showing one of the lateral screen members in the fully extended state in greater detail.
Figure 14:
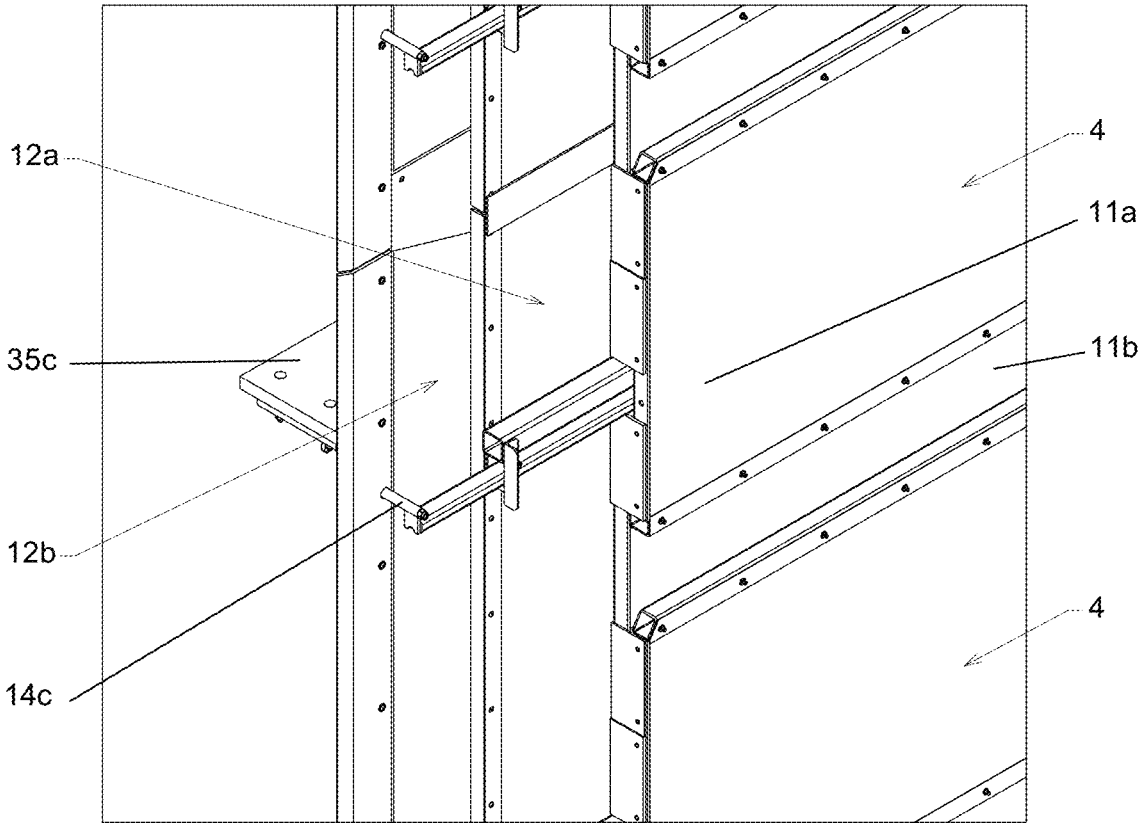
FIG. 14 is a detailed side perspective view of the safety screen of FIG. 12 showing one of the lateral screen members in a partially retracted state.
Figure 15:
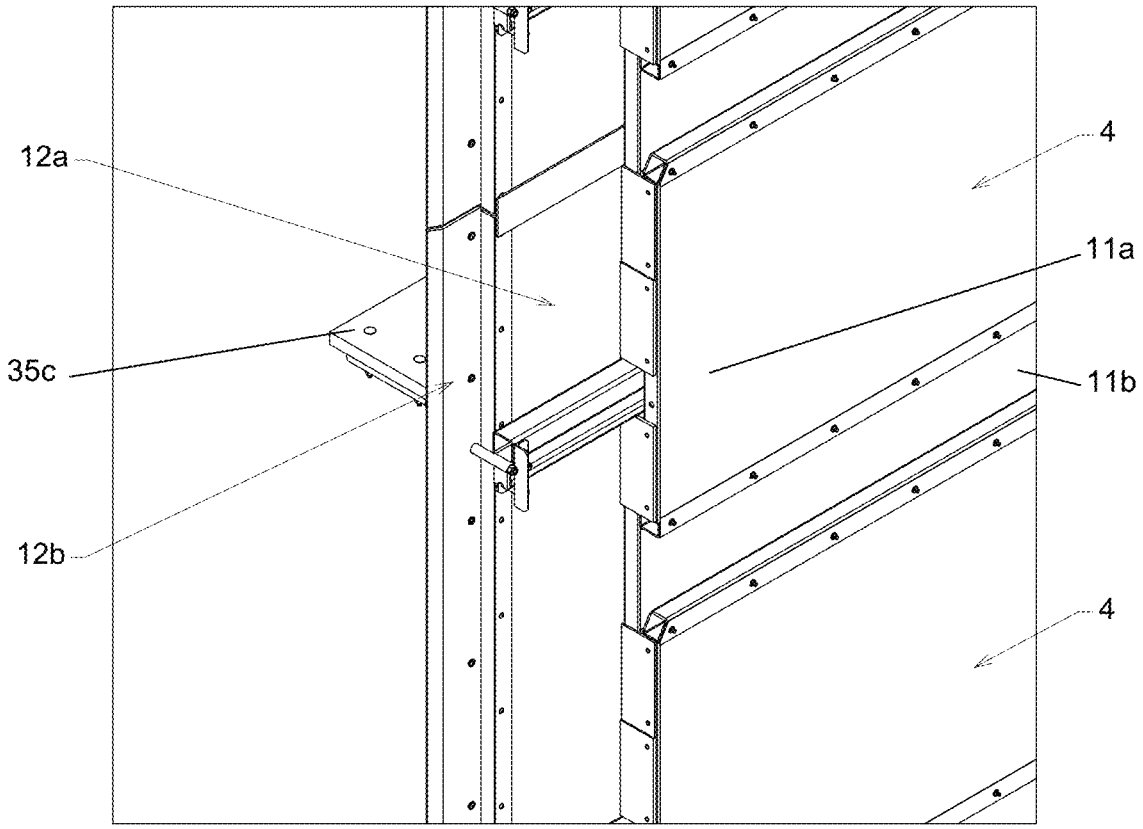
FIG. 15 is a detailed side perspective view of the safety screen of FIG. 12 showing one of the lateral screen members in a fully retracted state.

In the initial shown example, the lateral screen member 12 has an inner panel 12*a* and an outer panel 12*b*, the outer panel 12*b* being moveable laterally (i.e. in horizontal direction parallel to the main plane of the safety screen 1) between an extended state (see FIG. 1, FIG. 2, FIG. 3 and in greater detail FIG. 12 and FIG. 13), a partially retracted state (see FIG. 14) and a fully retracted state (see FIG. 15). In this initial shown example, the inner panel 12*a* is immovable and the outer panel 12*b* is displaced laterally.

Figure 31:
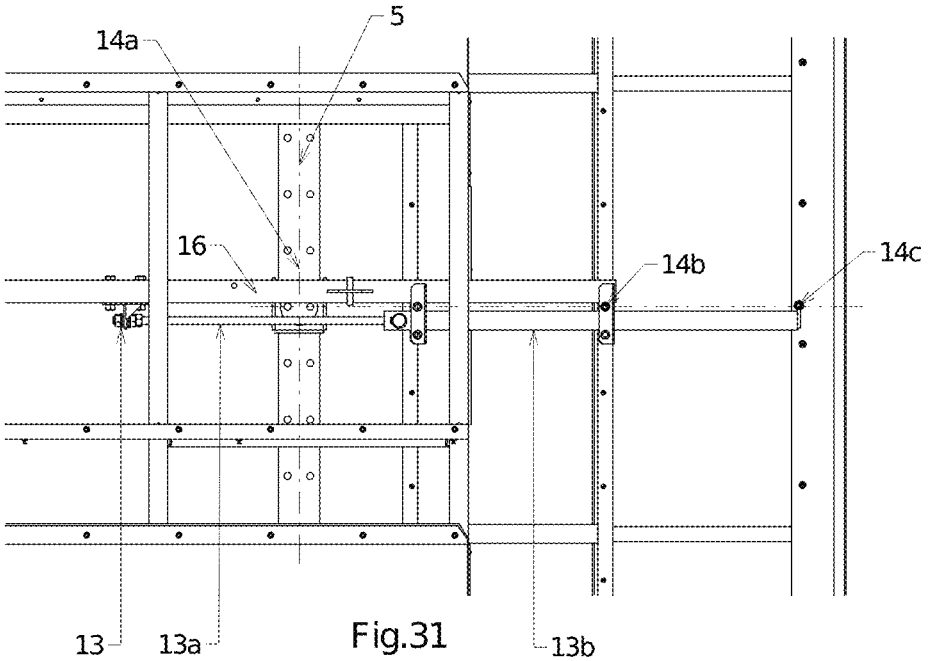
FIG. 31 is a detailed plan view and FIG. 32 is a detailed side perspective view of the back side of the safety screen of FIG. 5.
Figure 32:
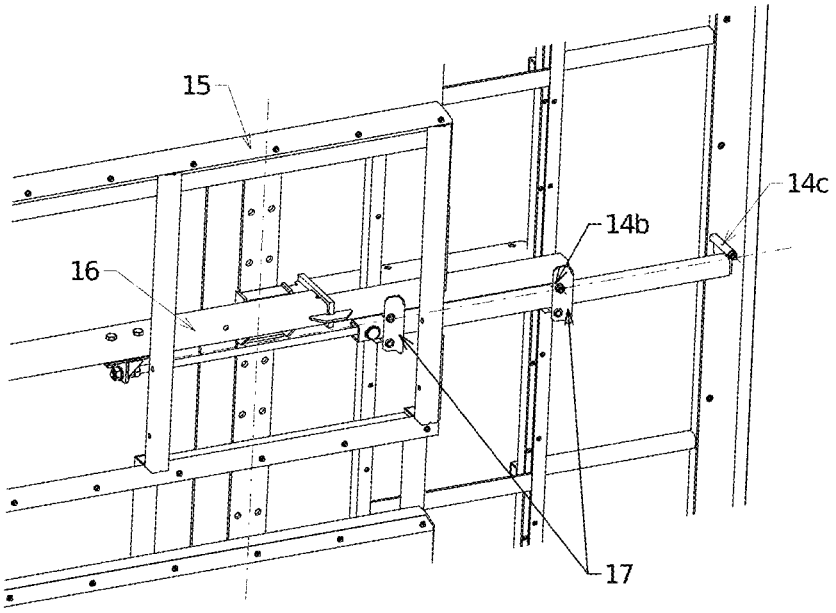

As can best be seen in FIG. 31 and FIG. 32, extension devices 13 are arranged for moving the outer panel 12*b* horizontally with respect to the inner panel 12*a*. Preferably, the extension devices 13 are telescopic. In the initial shown example, the extension devices 13 each have a threaded bar 13*a* engaging a threaded tube 13*b*.

As can further be seen in FIG. 31 and FIG. 32, first pivot axes 14*a* of the screen members 4, second pivot axes 14*b* of the inner panels 12*a* and third pivot axes 14*c* of the outer panels 12*b* of the lateral screen members 12 are arranged in identical horizontal lines independently of the inclination of the safety screen 1.

As can further be seen in FIG. 31 and FIG. 32, the screen members 4 each have a frame 15 for attaching the first screen panel 11*a* (not shown) and second screen panel 11*b* (not shown). At the back side of the frames 15 transverse bars 16 pivotally connect to the longitudinal carriers 5. The inner panels 12*a* of the lateral screen members 12 pivotally connect to ends of the transverse bars 16. The outer panels 12*b* of the lateral screen members 12 pivotally connect to the one ends of the extension device 13, whereas the other ends of the extension devices 13 are fixed to the transverse bars 16. In the initial shown example, horizontal guides 17 support the extension devices 13.

Figure 4:
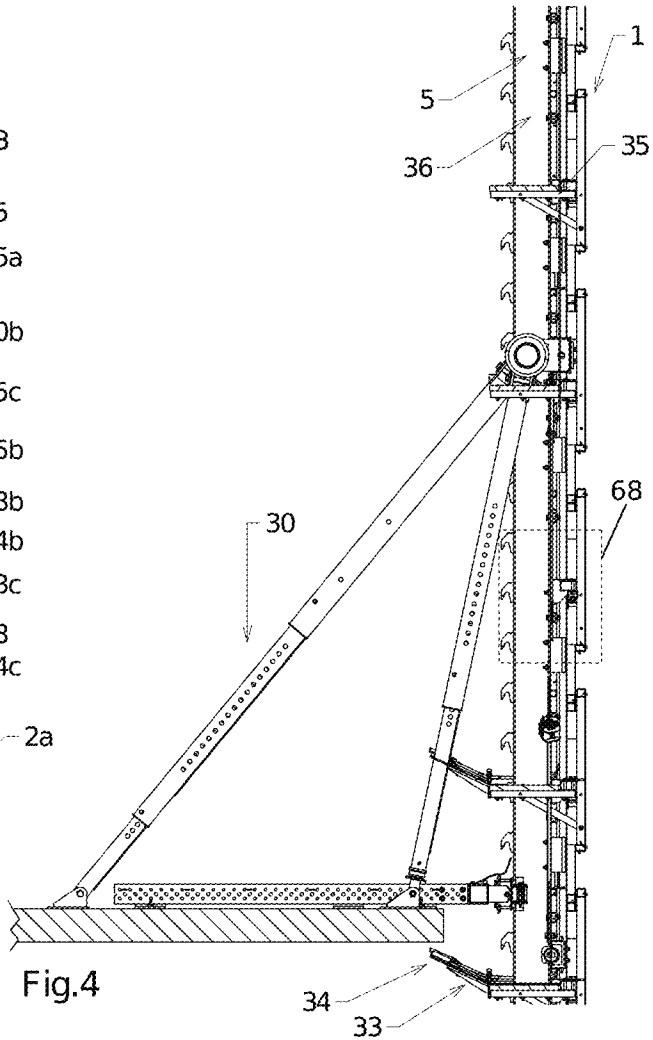
FIG. 4 is a detailed side plan view of the safety screen of FIG. 1.
Figure 16:
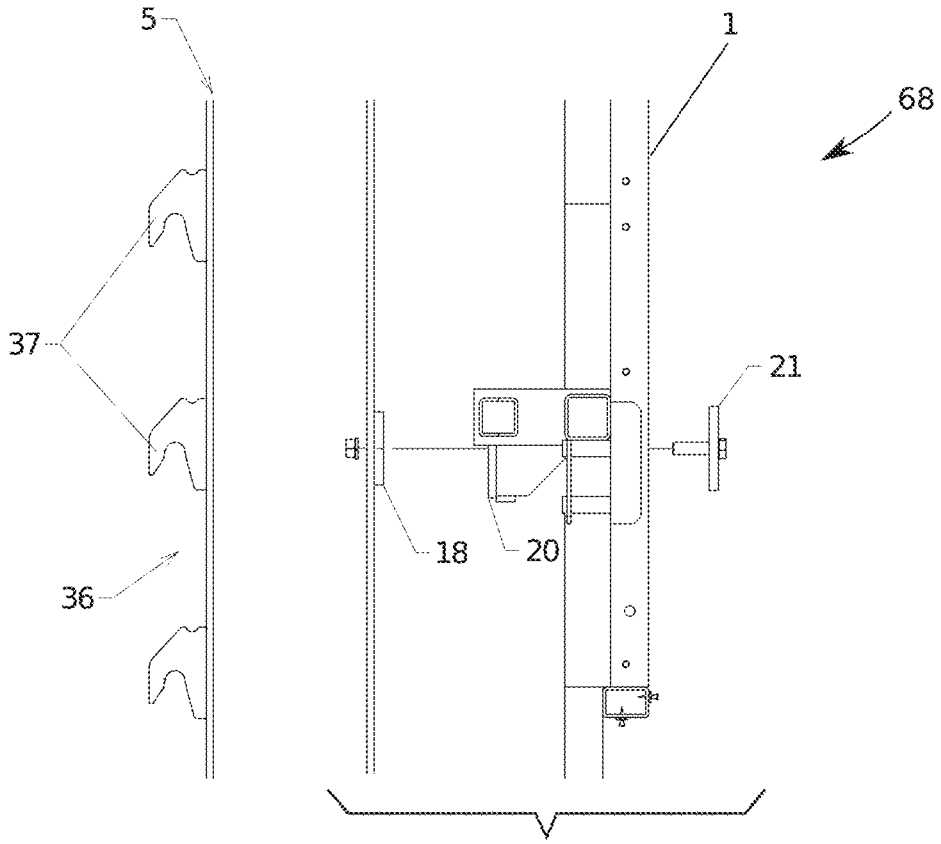
FIG. 16 is a magnified exploded side plan view and FIG. 17 is a magnified exploded side perspective view of a first pivot connection between one of the screen members and one of the longitudinal carriers of the safety screen shown in FIG. 4.
Figure 17:
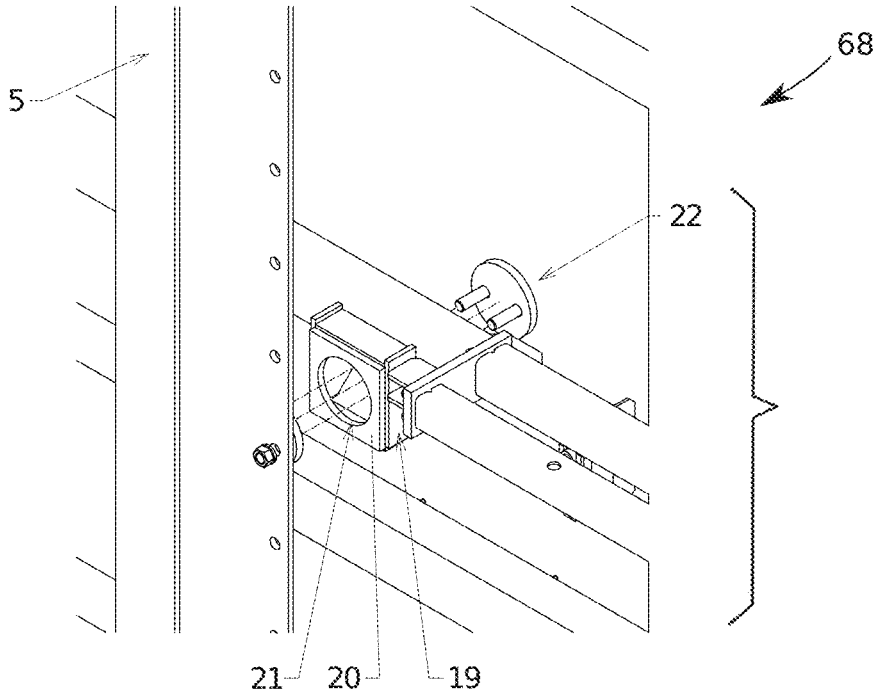

FIG. 16 and FIG. 17 show a magnified detail 68 of FIG. 4 with a first pivot connection between one of the screen members 4 and one of the longitudinal carriers 5. In the initial shown example, the first pivot connection comprises a first disk element 18 fixed to a back side of the longitudinal carrier 5 and a housing 19 with a front plate 20 having a through opening 21. The first disk element 18 accurately fits into the opening 21 of the housing 20. The first disk element 18 is circular in cross-section to be rotatably arranged in the correspondingly shaped opening 21 of the housing 20. A second disk element 22 is inserted into the housing 19 from the side facing away from the longitudinal carrier 5. The second disk element 22 has a diameter larger than the opening 21 so that the housing 20 is secured to the longitudinal carrier 5 in direction of the first pivot axis 14*a*.

Figure 5:
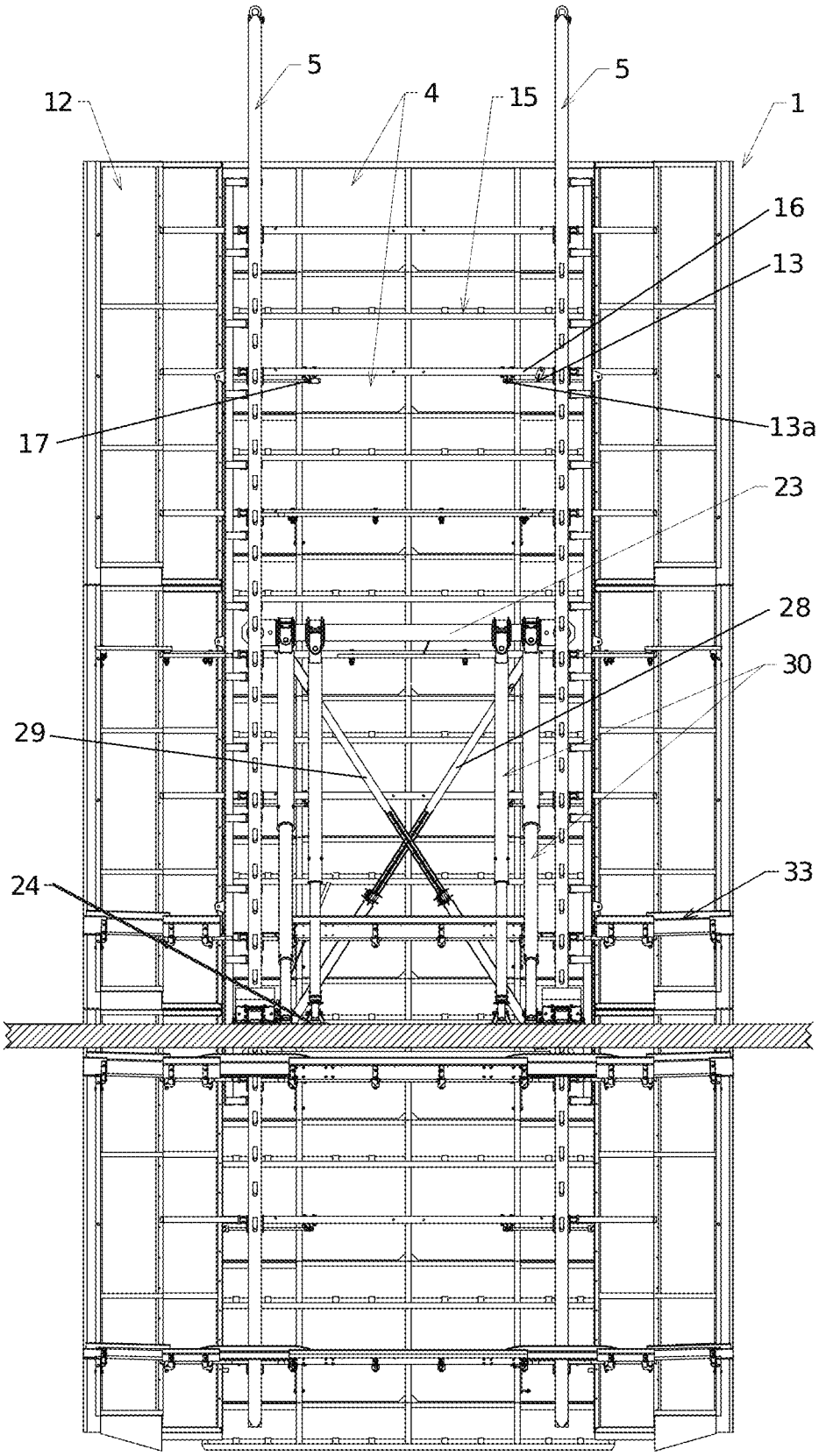
FIG. 5 is rear plan view of the safety screen of FIG. 1 seen from inside the concrete structure.

As can best be seen in FIG. 5 (and in greater detail in FIGS. 24 to 27), the safety screen 1 further comprises a first (upper) horizontal bracing 23 and a second (lower) horizontal bracing 24 spaced vertically from one another. Each of the first horizontal bracing 23 and second horizontal bracing 24 is pivotally connected to the longitudinal carriers 5 so that the first horizontal bracing 23 and the second horizontal bracing 24 extend horizontally (laterally) independently of the sideward inclination of the longitudinal carriers 5. In the initial shown example, the first horizontal bracing 23 is elongate with a first end 23*a* and a second end 23*b* pivotally connected to a first longitudinal carrier of the longitudinal carriers 5 and a second longitudinal carrier of the longitudinal carriers 5, respectively. Likewise, the second horizontal bracing 24 is elongate with a first end 24*a* and a second end 24*b* pivotally connected to the first longitudinal carrier and the second longitudinal carrier, respectively.

Figure 20:
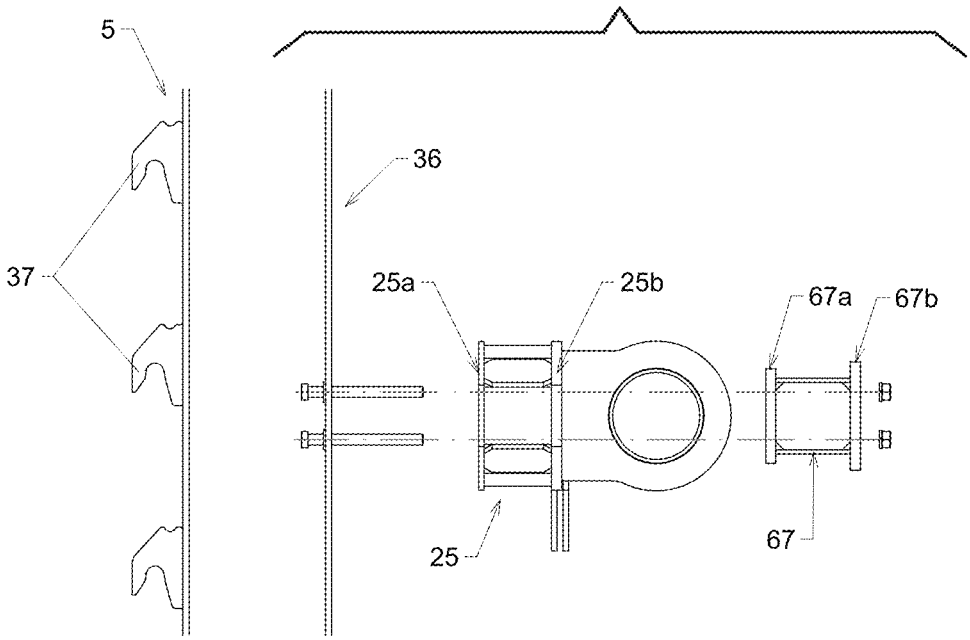
FIG. 20 is a detailed exploded side plan view and FIG. 21 is a detailed exploded side perspective view of a second pivot connection between a first horizontal bracing and one of the longitudinal carriers of the safety screen shown in FIGS. 9 and 10.
Figure 21:
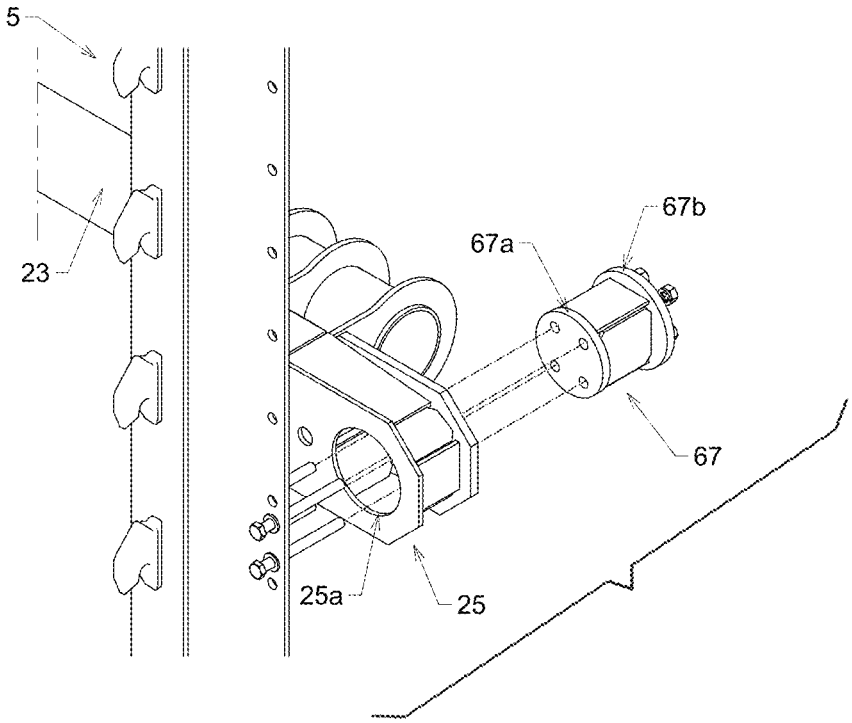

FIG. 20 and FIG. 21 show a second pivot connection between the first horizontal bracing 23 and one of the longitudinal carriers 5. In the initial shown example, the second pivot connection comprises a first insert 67 fixed to a back side of the longitudinal carrier 5 and a body member 25 for accommodating the first insert 67. The first insert 67 has a first circular support surface 67*a* and a second circular support surface 67*b*. The second circular support surface 67*b* is larger in diameter than the first circular support surface 67*a*. The body member 25 has a first circular opening 25*a* for a rotatable support of the first circular support surface 67*a* and a second circular opening 25*b* which is covered by the larger diameter of the second circular support surface 67*b* thus securing the body member 25 to the longitudinal carrier 5 in direction of the second pivot axis.

Figure 22:
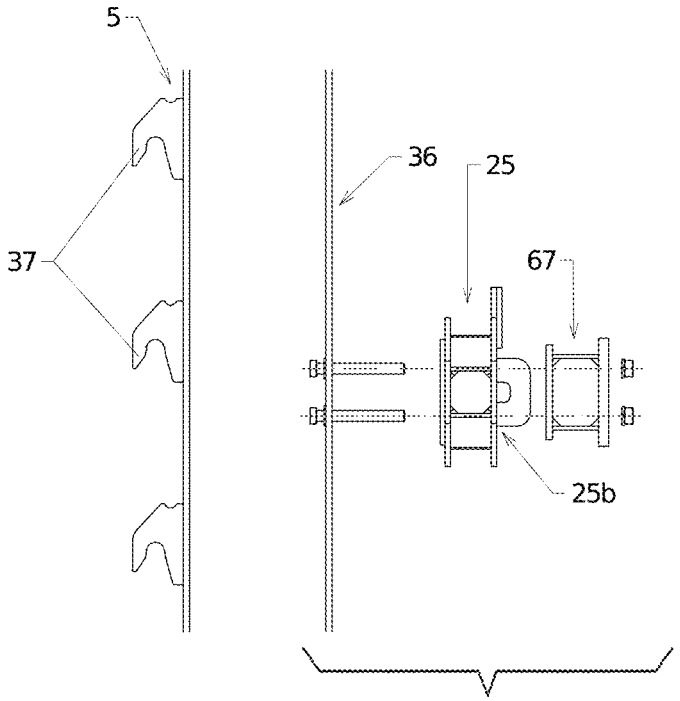
FIG. 22 is an exploded side plan view and FIG. 23 is an exploded side perspective exploded view respectively of a third pivot connection between a second horizontal bracing and one of the longitudinal carriers of the safety screen shown in FIG. 5.
Figure 23:
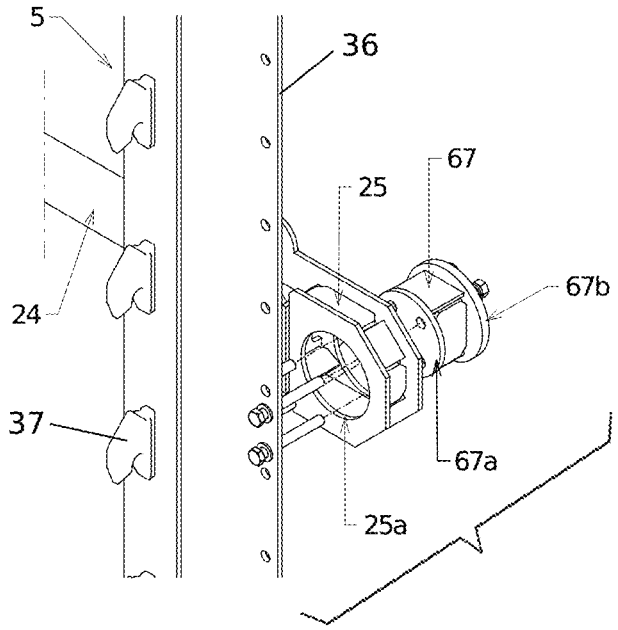
Figure 24:
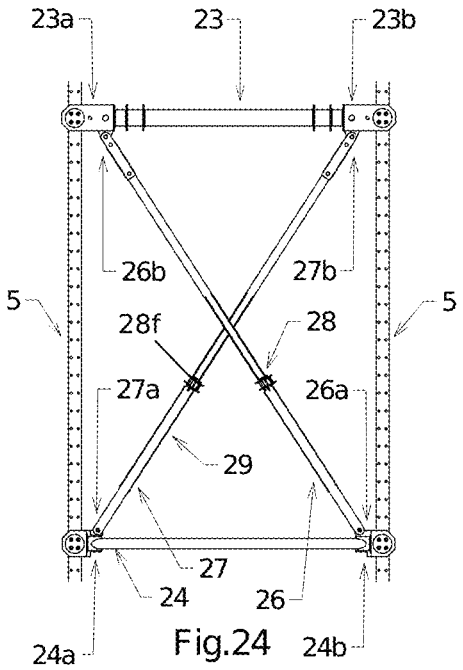
FIG. 24 is a detailed plan view and FIG. 25 is a detailed side perspective view of the first and second horizontal bracings and a first and a second diagonal adjustment member as shown in FIG. 5 in the first operating position of the safety screen.
Figure 25:
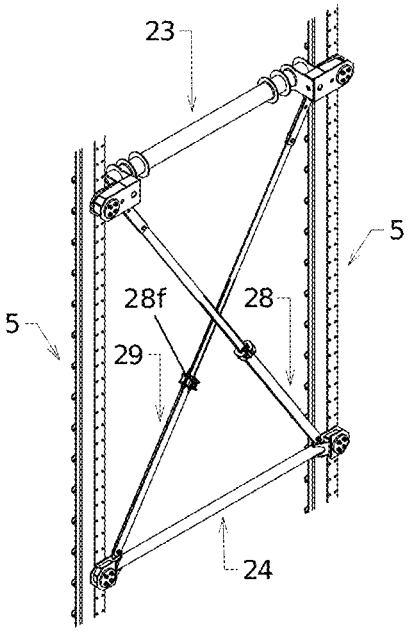
Figure 26:
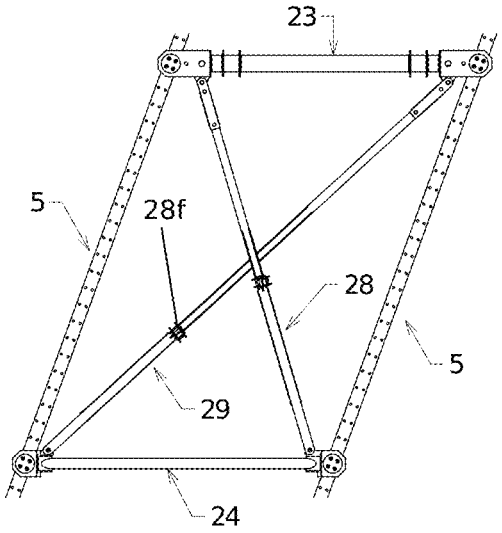
FIG. 26 is a detailed plan view and FIG. 27 is a detailed side perspective view of the first and second horizontal bracings and the first and second diagonal adjustment members as shown in FIG. 5 in the second operating position of the safety screen.
Figure 27:
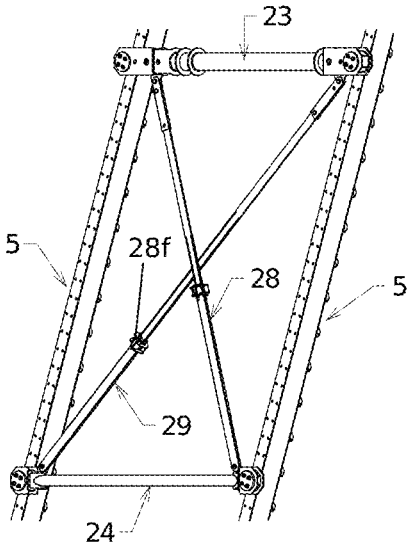

FIG. 22 and FIG. 23 illustrate a third pivot connection between the second horizontal bracing 24 and one of the longitudinal carriers 5. The functioning of the third pivot connection is equivalent to the second pivot connection (see above).

FIGS. 24, 25, 26 and 27 illustrate portions of the initial shown example for adjusting the sideward tilt of the safety screen 1.

In the initial shown example, a first diagonal adjustment member 26 and a second diagonal adjustment member 27 are arranged for adjusting the sideward inclination of the longitudinal carriers 5. The first diagonal adjustment member 26 has a first end 26*a* and a second end 26*b*, wherein the first end 26*a* of the first diagonal adjustment member 26 is pivotally connected to the first end 23*a* of the first horizontal bracing 23 and the second end 26*b* of the first diagonal adjustment member 26 is pivotally connected to the second end 24*b* of the second horizontal bracing 24. The second diagonal adjustment member 27 has a first end 27*a* and a second end 27*b*, wherein the first end 27*a* of the second diagonal adjustment member 27 is pivotally connected to the first end 24*a* of the second horizontal bracing 24 and the second end 27*b* of the second diagonal adjustment member 27 is pivotally connected to the second end 23*b* of the first horizontal bracing 23. In this way, the sections of the longitudinal carriers 5 between the second and third pivot connections, the first horizontal bracing 23 and the second horizontal bracing 24 form a rectangle in the first operating position and a rhomboid in the second operating position.

Figure 28:
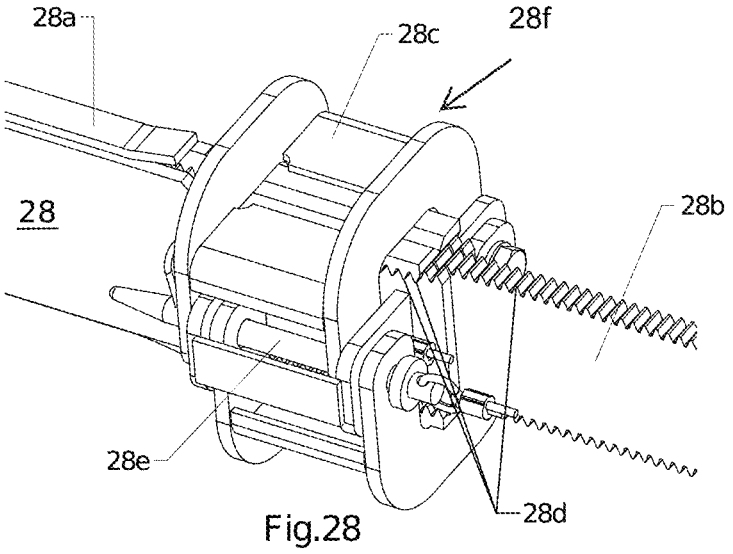
FIG. 28 is a detailed side perspective view of the first and second diagonal adjustment member of FIG. 24 to FIG. 27 in a locked state for maintaining a given sideward tilt of the longitudinal carriers.
Figure 29:
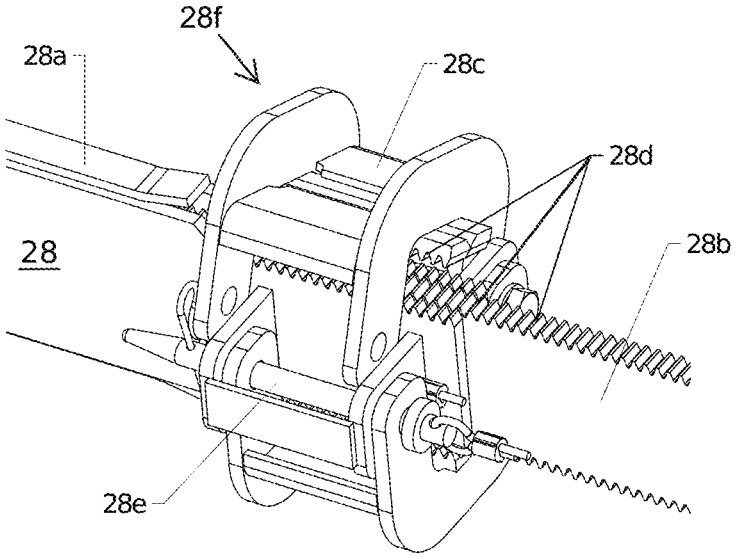
FIG. 29 is a detailed side perspective view of the first and second diagonal adjustment member of FIG. 24 to FIG. 27 in a released state for adjusting the sideward tilt of the longitudinal carriers.
Figure 30:
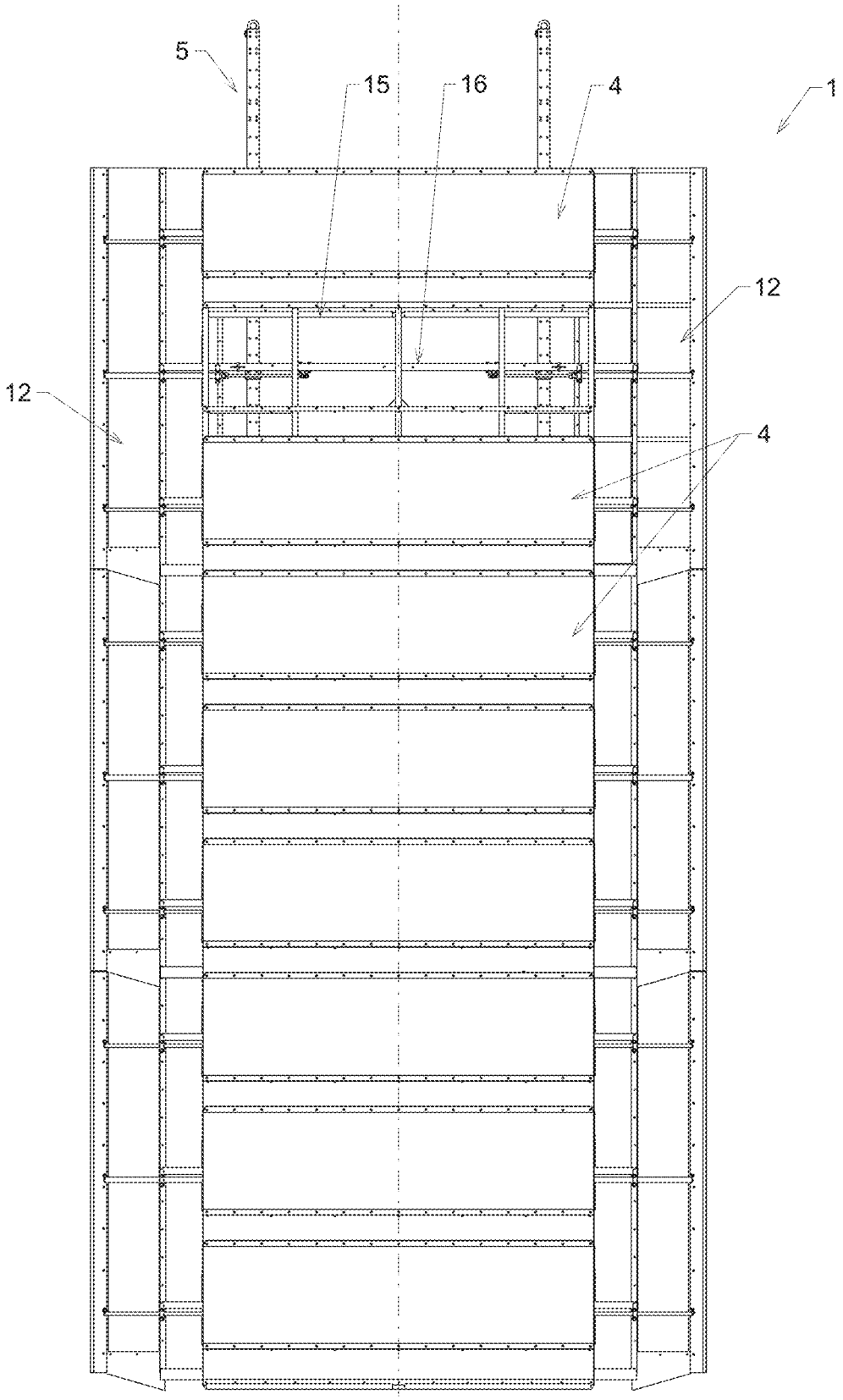
FIG. 30 is a front plan view of the safety screen of FIG. 1, wherein a first and second screen panel of one of the screen members have been removed so that a frame supporting this screen member can be seen.

The first diagonal adjustment member 26 may comprise a first telescopic bar 28 adjustable in length. In the initial shown example, the first telescopic bar 28 has an assembly 28*f* with a first longitudinal part 28*a*, a second longitudinal part 28*b* and a locking member 28*c* for locking the first longitudinal part 28*a* and the second longitudinal part 28*b* at a given length of the first telescopic bar 28. For this purpose, the first longitudinal part 28*a*, second longitudinal part 28*b* and locking member 28*c* may have correspondingly shaped locking teeth 28*d* that engage one another in a locking position shown in FIG. 28. The locking member 28*c* can be released (see FIG. 29) to disengage the locking teeth 28*d* from one another and allow for adjustment of the length of the telescopic bar 28. In the initial shown example, a removable locking pin 28*e* is provided for securing the locking member 28*c* in the locking position. The second diagonal adjustment member 27 may comprise a second telescopic bar 29 adjustable in length. The construction of the second diagonal adjustment member 27 may be identical to the first diagonal adjustment member 26 so that explanations thereof are omitted herein.

In the initial shown example, the safety screen 1 may be tilted backwards with respect to the vertical first operating position so that the upper edge 6 of the safety screen 1 is displaced outwardly, away from the edge 2*a* of the floor 2. Furthermore, the safety screen 1 may be tilted forwards with respect to the vertical first operating position so that the upper edge 6 of the safety screen 1 projects inwardly from the edge 2*a* into the space above the floor 2. Thus, in a third operating position, the longitudinal carriers 5 are inclined backwards from their vertical arrangement in the first operating position. In a fourth operating position, the longitudinal carriers are inclined forward from vertical. The backward or forward tilt of the safety screen 1 may be combined with the sideward tilt of the safety screen 1 described above.

Figure 7:
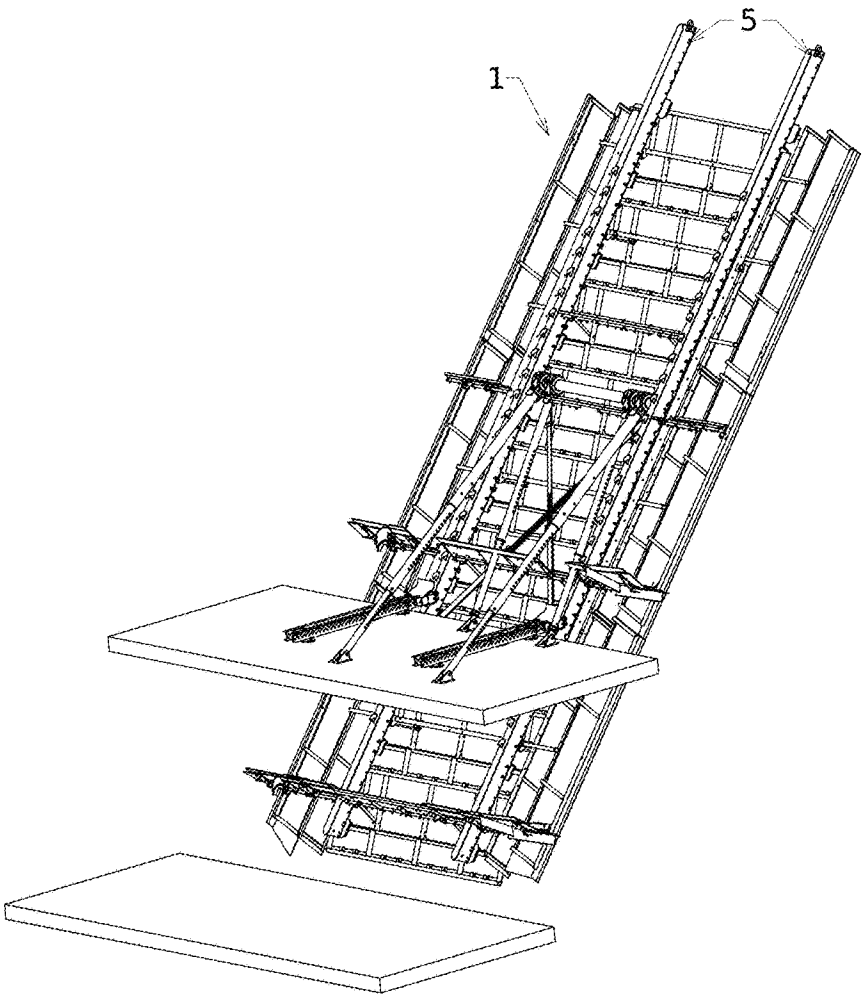
FIG. 6 and FIG. 7 are side perspective views of the safety screen of FIG. 1 in a fifth operating position, wherein the safety screen is tilted backward and sideward in opposite directions, respectively.
Figure 6:
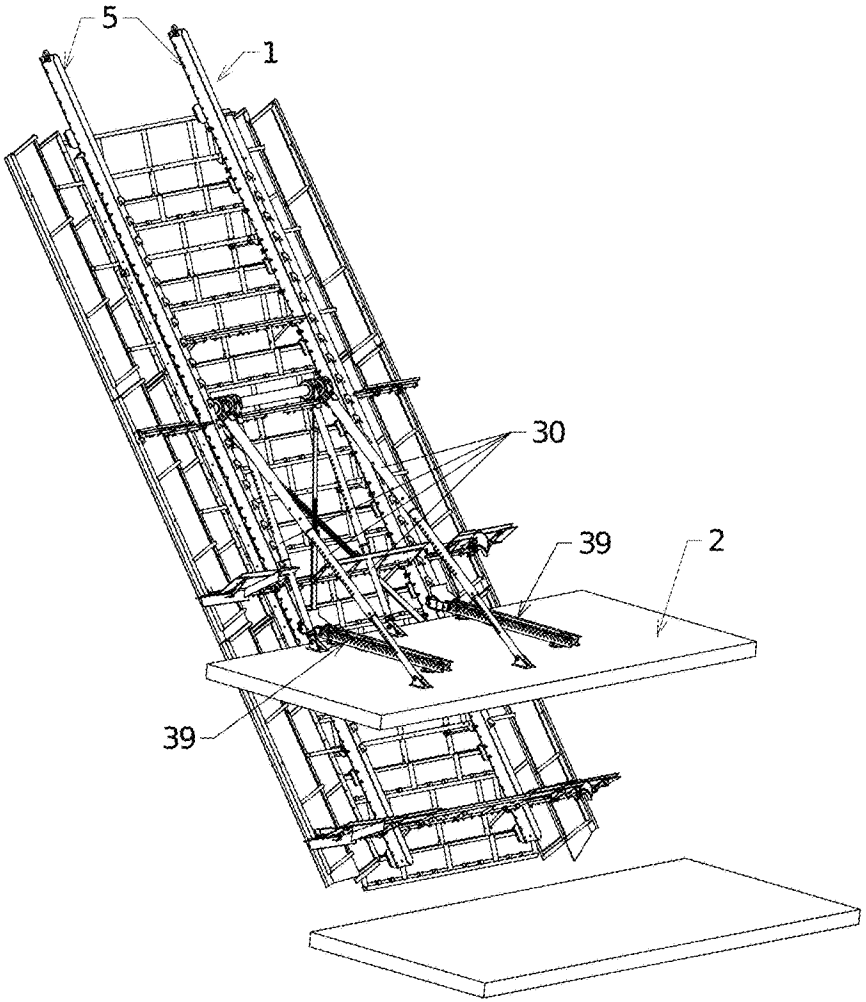
Figure 9:
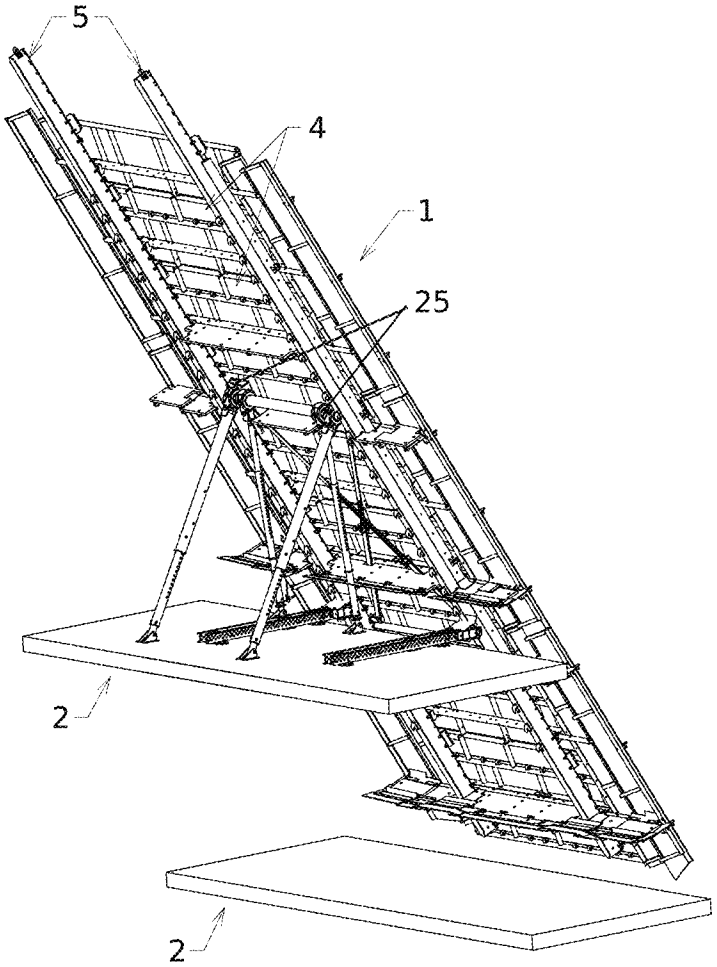
FIG. 8 and FIG. 9 are side perspective views of the safety screen of FIG. 1 in a sixth operating position, wherein the safety screen is tilted forward and sideward in opposite directions, respectively.
Figure 8:
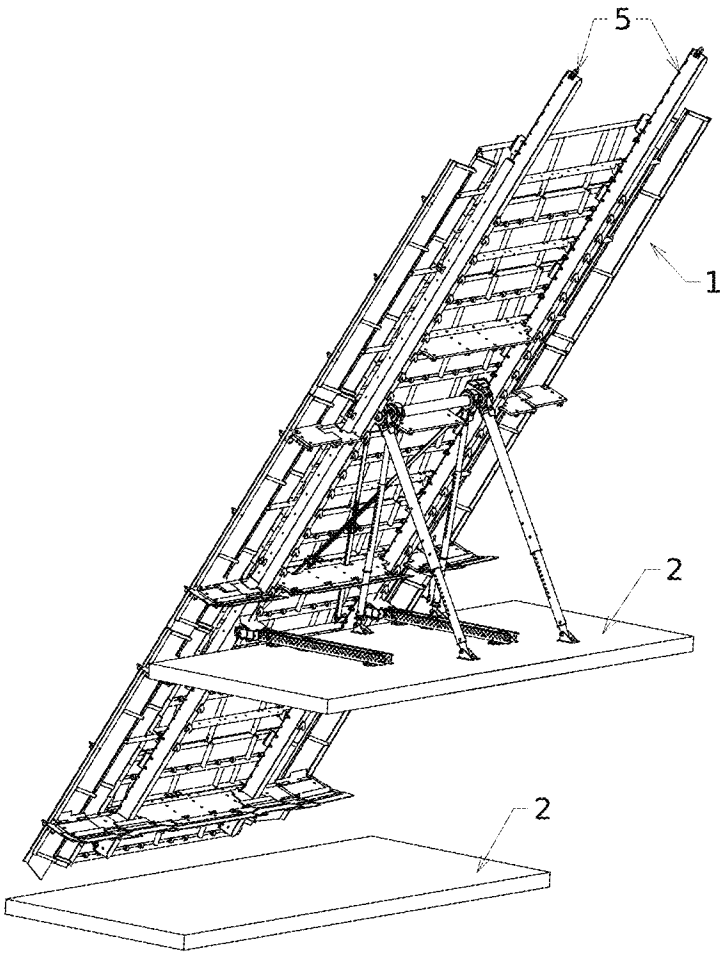

FIG. 6 and FIG. 7 show the safety screen 1 in a fifth operating position (backward tilt and sideward tilt in the first and second direction, respectively). FIG. 8 and FIG. 9 show the safety screen (shield) 1 in a sixth operating position (forward tilt and sideward tilt in the first and second direction, respectively).

Figure 10:
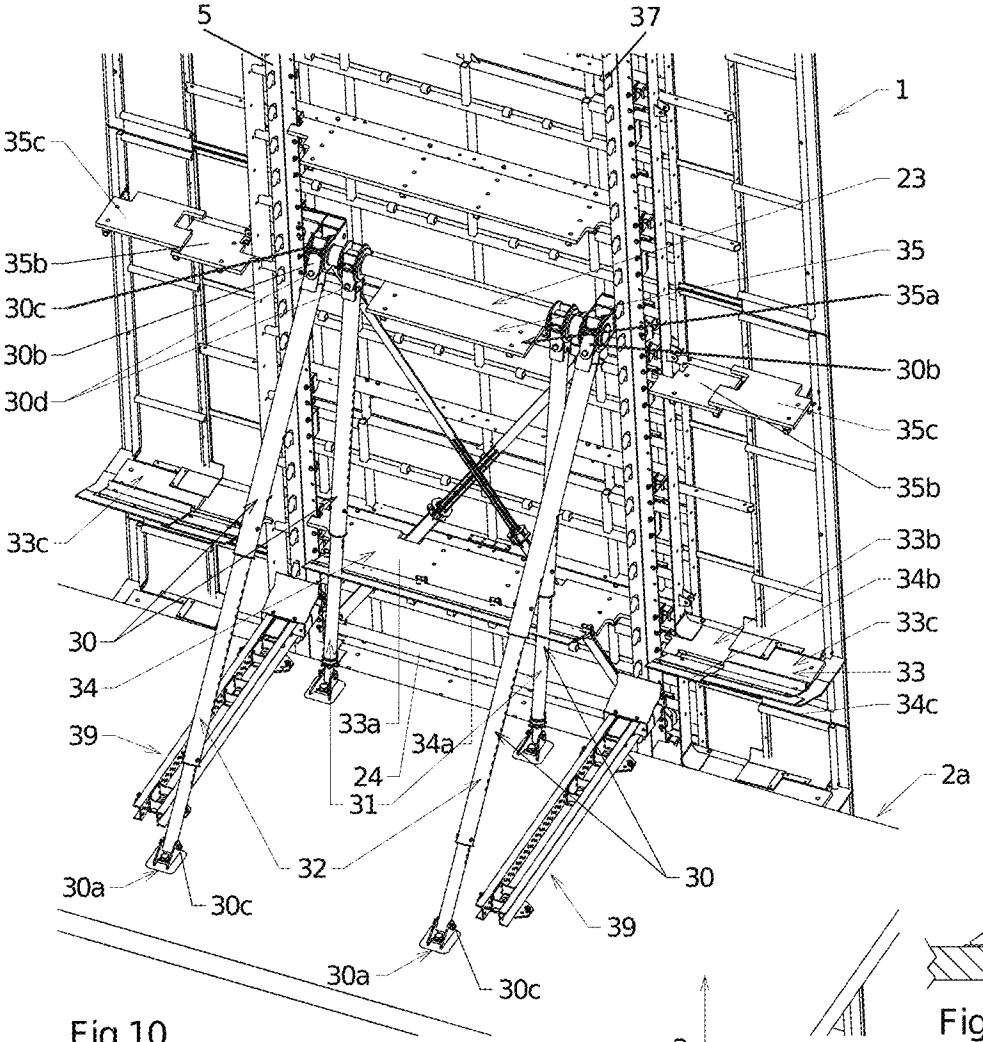
FIG. 10 is a detailed side perspective view of the safety screen of FIG. 1 in the first operating position.
Figure 11:
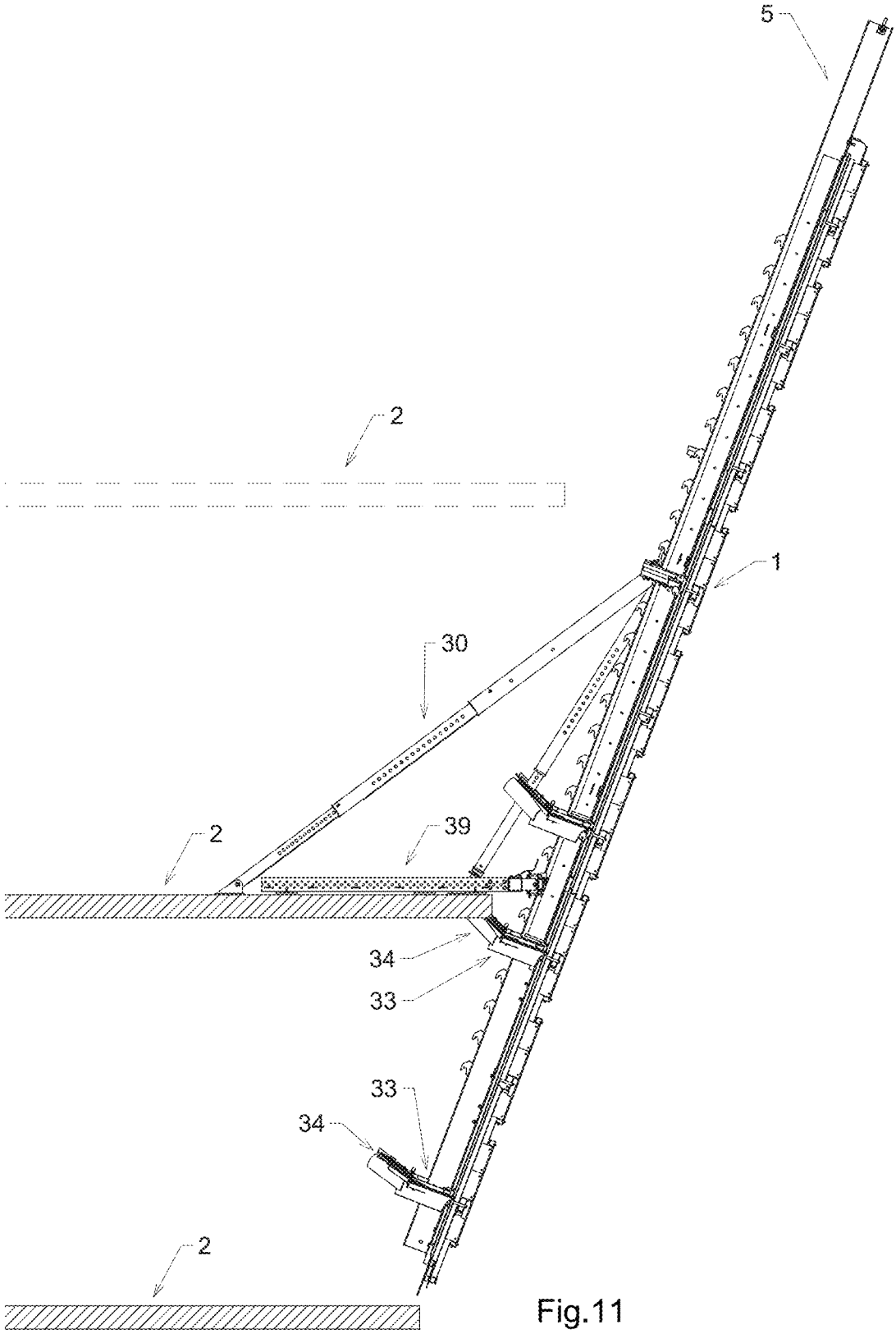
FIG. 11 is a side plan view of the safety screen of FIG. 1 in a position tilted backward.

In the initial shown example, at least two anchoring bars 30 are fixed on the floor 2 for maintaining the safety screen 2 in one of the first, second, third, fourth, fifth or sixth operating position (see, for example, FIG. 10 and FIG. 11). The one ends 30*a* of the anchoring bars 30 are attached to the floor 2, whereas the other ends 30*b* of the anchoring bars 30 are connected to the first horizontal bracing 23. To allow for the forward and backward tilting of the safety screen 1, the one ends 30*a* and the other ends 30*b* are pivotable about laterally extending pivot axes 30*c* against the floor 2 and the first horizontal bracing 23, respectively.

Figure 18:
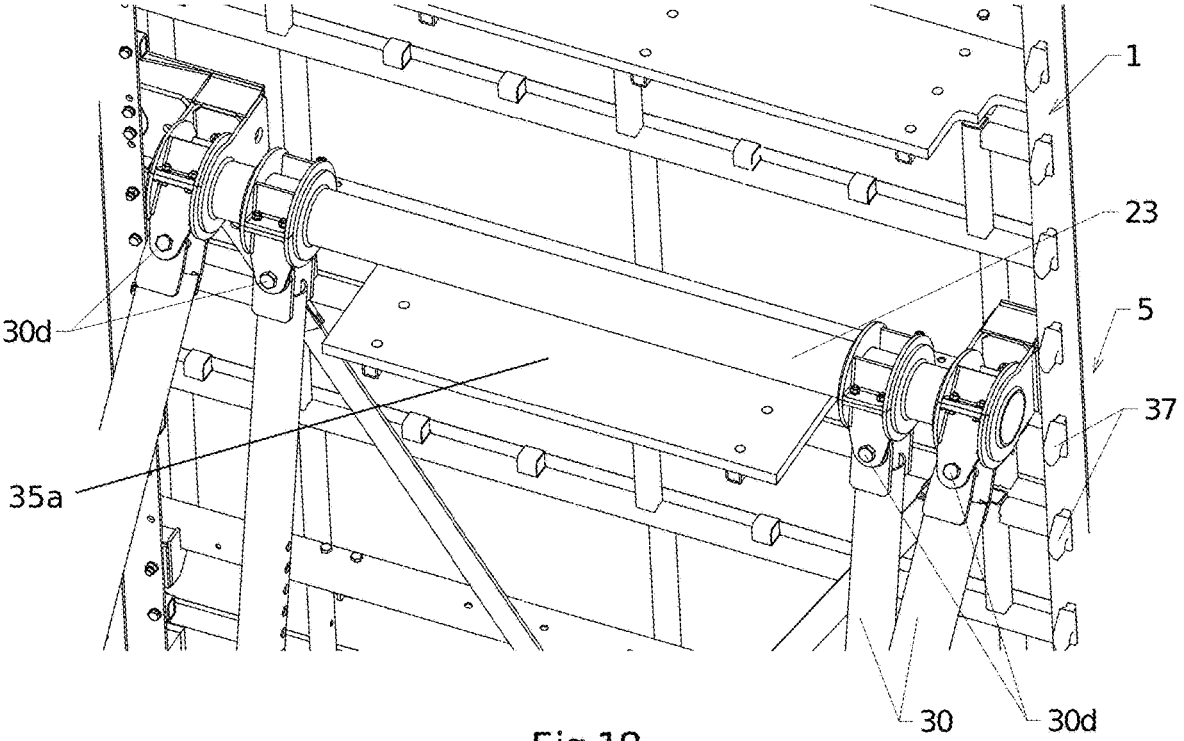
FIG. 18 and FIG. 19 are detailed side perspective views of the safety screen of FIG. 10 showing the attachment of anchoring bars for maintaining the safety screen in a given backward or forward tilt with FIG. 18 providing a view from the top down and FIG. 19 providing a view from the bottom up of the anchoring bars of FIG. 10.
Figure 19:
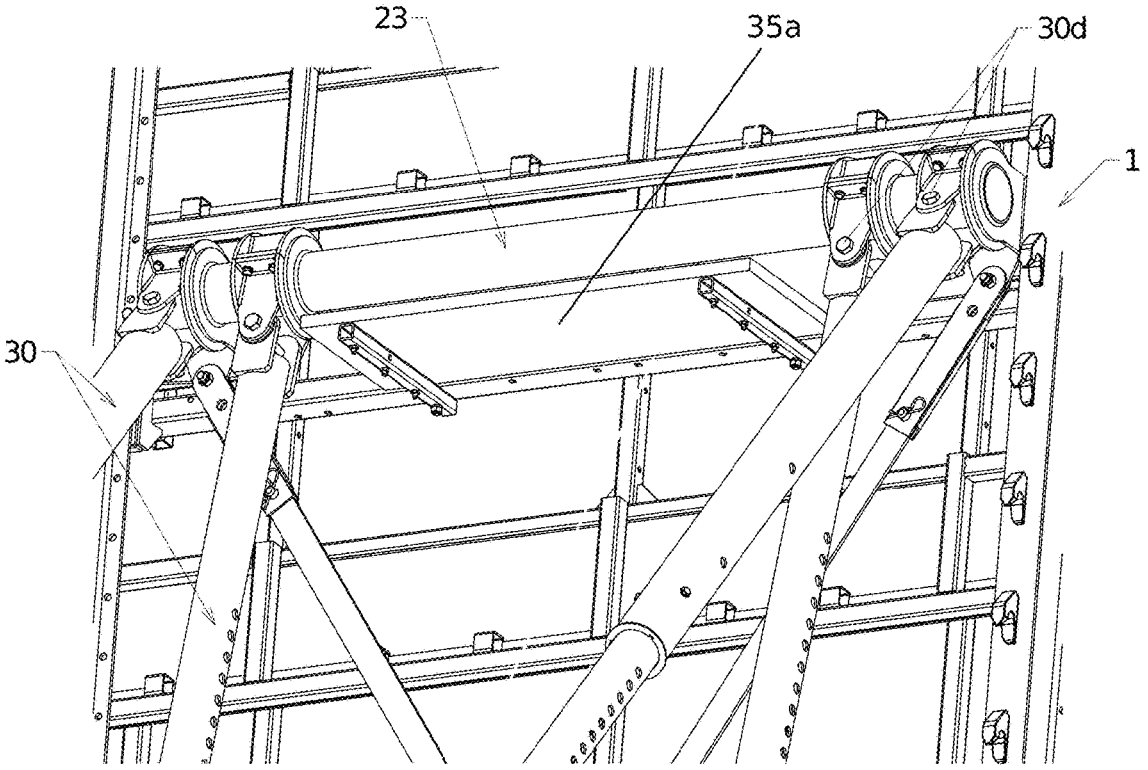

In the initial shown example, the other ends 30*b* of the anchoring bars 30 are pivotable about axes 30*d* perpendicular to the screening surface 1*a* (see FIG. 18 and FIG. 19 for greater detail) to allow for stowing of the anchoring bars 30 when moving the safety screen 1 upwards to the next floor 2.

In the initial shown example, the anchoring bars 30 are telescopic to allow for an adjustment of the length of the anchoring bars 30. Preferably, a first pair 31 of telescopic anchoring bars 30 and a second pair 32 of telescopic anchoring bars support the safety screen 1 on the floor 2. The first pair 31 of anchoring bars 30 is fixed to the floor 2 closer to the edge 2*a* than the second pair 32 of anchoring bars 30. In the initial shown example, the anchoring bars 30 are fixed on the floor 2 after the sideward tilt of the safety screen 1 was adjusted so that the loads from the safety screen 1 are effectively transferred into the floor 2 independently of the sideward tilt of the safety screen 1.

In the initial shown example, a skirt member 33 extends horizontally over a portion, in particular over the larger part of the lateral extension of the safety screen 1. The skirt member 31 projects inwards from one of the screen members 4 (see, in particular, FIG. 4, FIG. 10 and FIG. 11). The skirt member 33 has a middle skirt part 33*a* and, on either side of the middle skirt part 33*a*, a first lateral skirt extension 33*b* and a second lateral skirt extension 33*c*. The second lateral skirt extension 33*c* can be extended laterally from a position on top of the first lateral skirt extension 33*b* to a position extending the first lateral skirt extension 33*b* (see FIG. 10) when the lateral screen member 12 is brought into its extended state. The skirt member 33 is maintained in its horizontally extending position independently of the sideward tilt of the safety screen 1.

In the initial shown example, a flap member 34 is connected to a free end of the skirt member 33, the flap member 34 being pivotally connected to the skirt member 33 so that the flap member 34 can be pivoted upwards from the state shown in FIG. 10 extending the skirt member 33. The flap member 34 has a middle flap part 34*a* connected to the middle skirt part 33*a*, a first lateral flap part 34*b* connected to the first lateral skirt extension 33*b* and a second lateral flap part 34*c* connected to the second lateral skirt extension 33*c* on either side of the middle flap part 34*a*.

Figure 33:
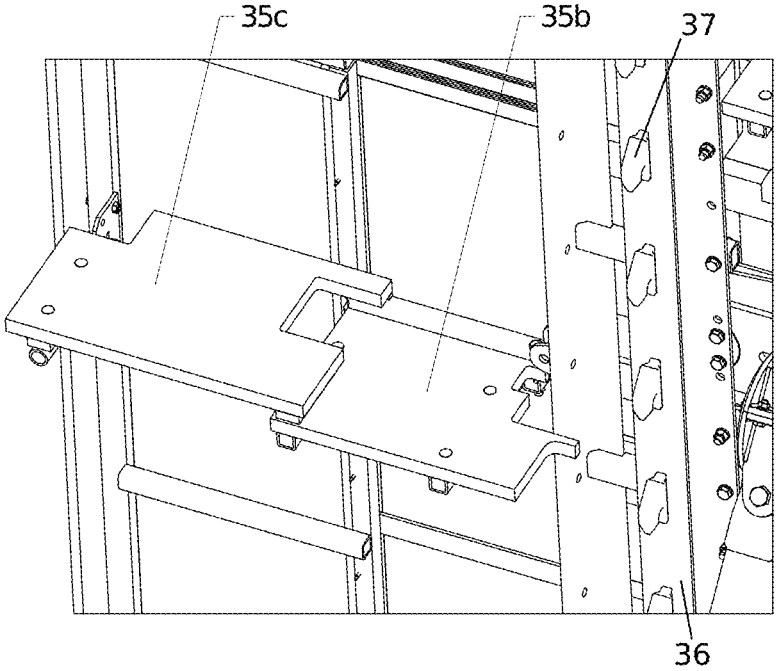
FIG. 33 is a detailed side perspective view and FIG. 34 is a detailed plan view of the back side of the safety screen as shown in FIG. 10 showing lateral platform parts in a fully extended state.

In the initial shown example, a platform 35 for workers projects inwards from one of the screen members 4 (see FIG. 10). The platform 35 has a middle platform part 35*a* and, on either side of the middle platform part 35*a*, a first lateral platform part 35*b* and a second lateral platform part 35*c* (see FIG. 33 to FIG. 38 for greater detail). The second lateral platform part 35*c* is extended laterally from a retracted position on top of the first lateral platform part 35*b* (see FIG. 37 and FIG. 38) via a partially extended position (see FIG. 35 and FIG. 36) to an extended position (see FIG. 33 and FIG. 34) extending the first lateral platform part 35*b* when the lateral screen member 12 is brought into its extended state. The platform 35 is maintained in its horizontally extending position independently of the sideward tilt of the safety screen 1.

Figure 34:
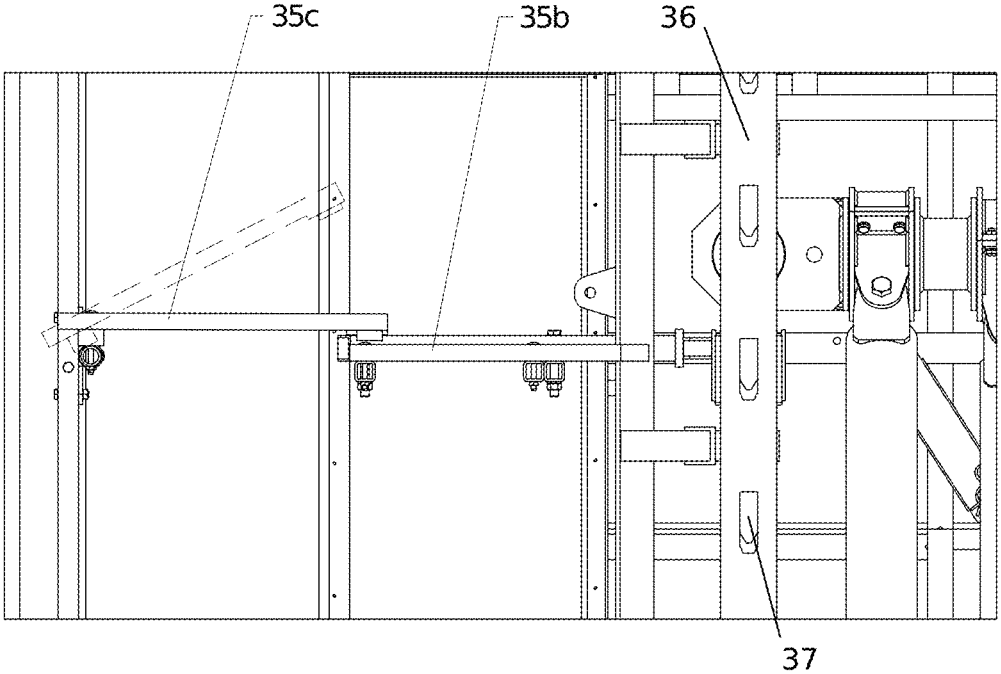
Figure 35:
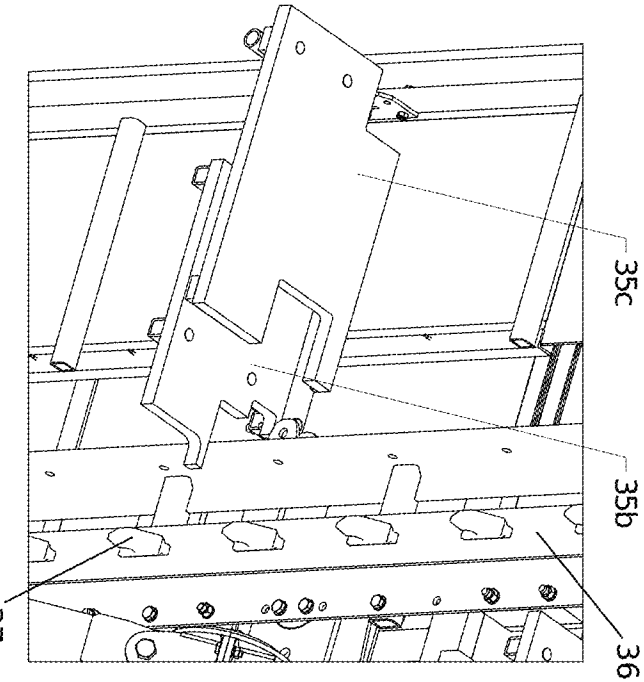
FIG. 35 is a detailed side perspective view and FIG. 36 is a detailed plan view of the back side of the safety screen as shown in FIG. 10 showing lateral platform parts in a partially retracted state.
Figure 36:
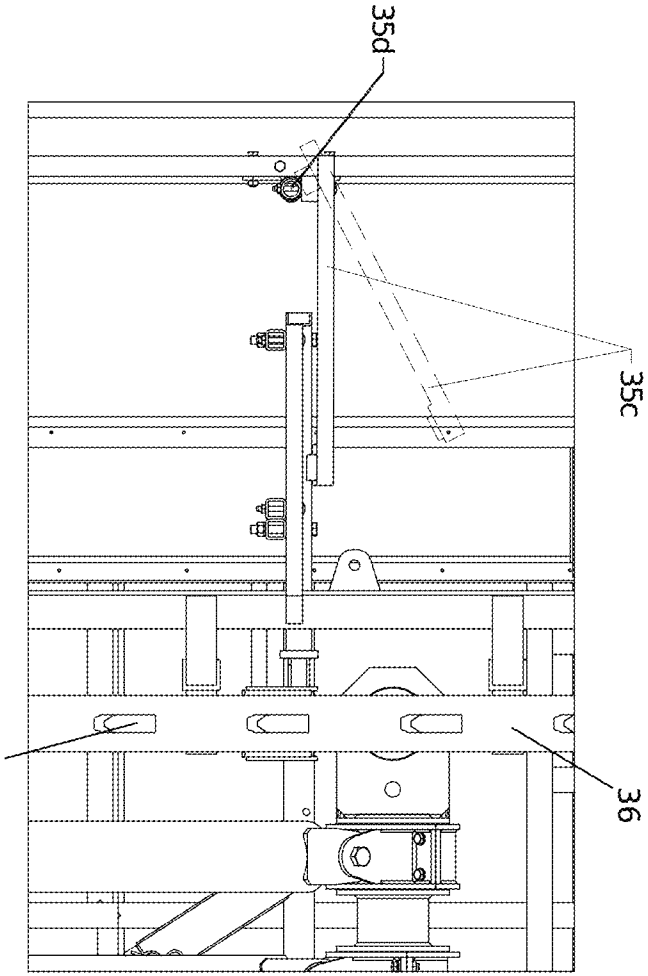
Figure 37:
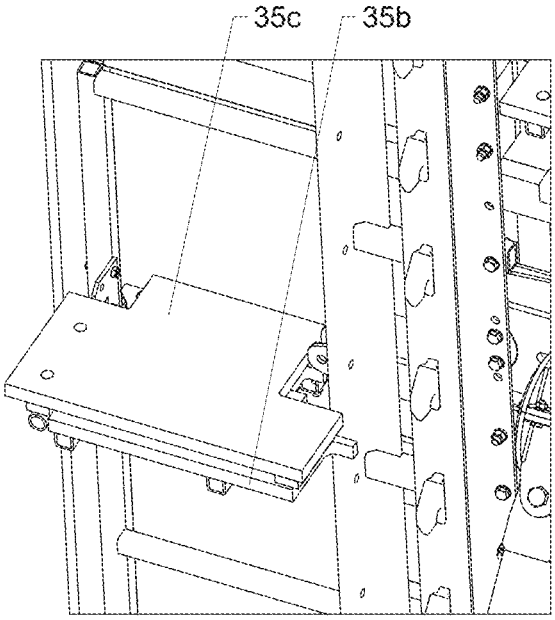
FIG. 37 is a detailed side perspective view and FIG. 38 is a detailed plan view of the back side of the safety screen as shown in FIG. 10 showing lateral platform parts in a fully retracted state.
Figure 38:
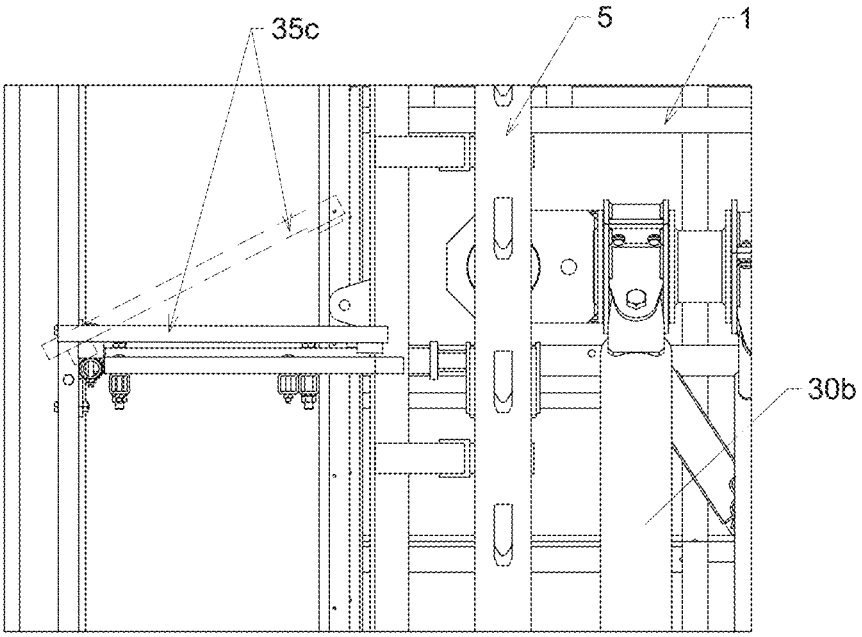
Figure 41:
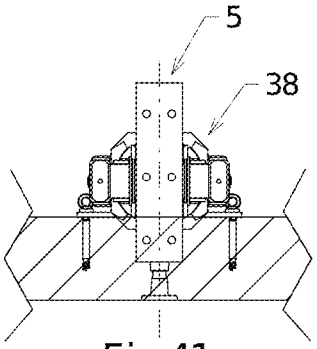
FIG. 41 is a detailed end plan view of a climbing shoe as shown in FIG. 6 in which the climbing shoe is attached to an end of a support arm, the climbing shoe supporting a climbing rail which is an integral part of the longitudinal carrier in a vertical position.
Figure 39:
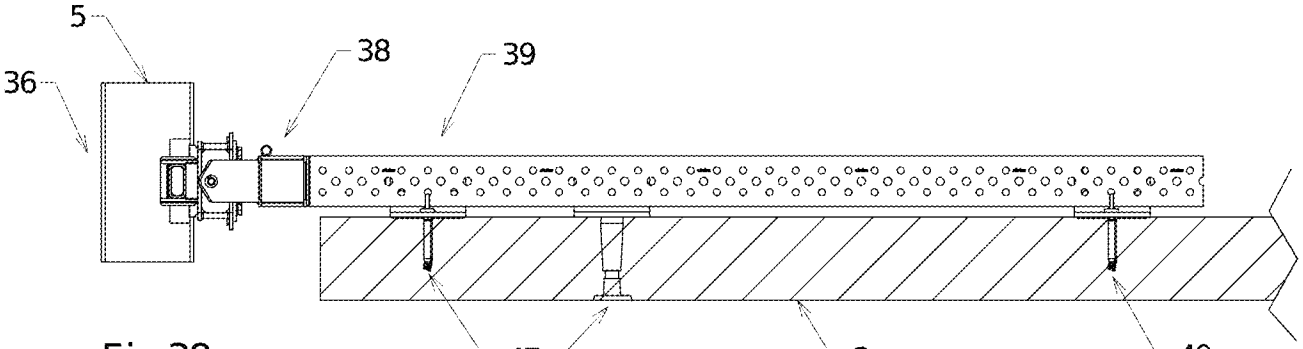
FIG. 39 is a detailed side plan view of a climbing shoe as shown in FIG. 6.
Figure 40:
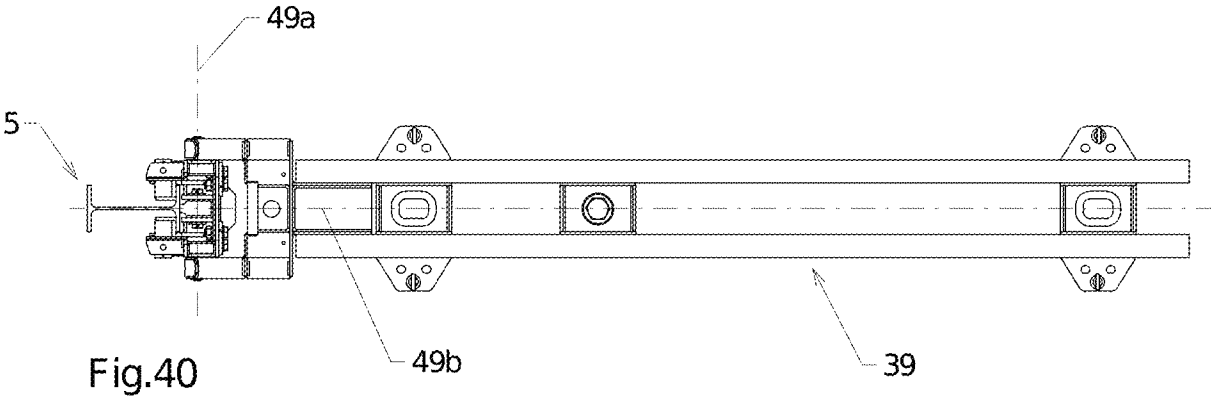
FIG. 40 is a detailed plan view from above of a climbing shoe as shown in FIG. 6.
Figure 42:
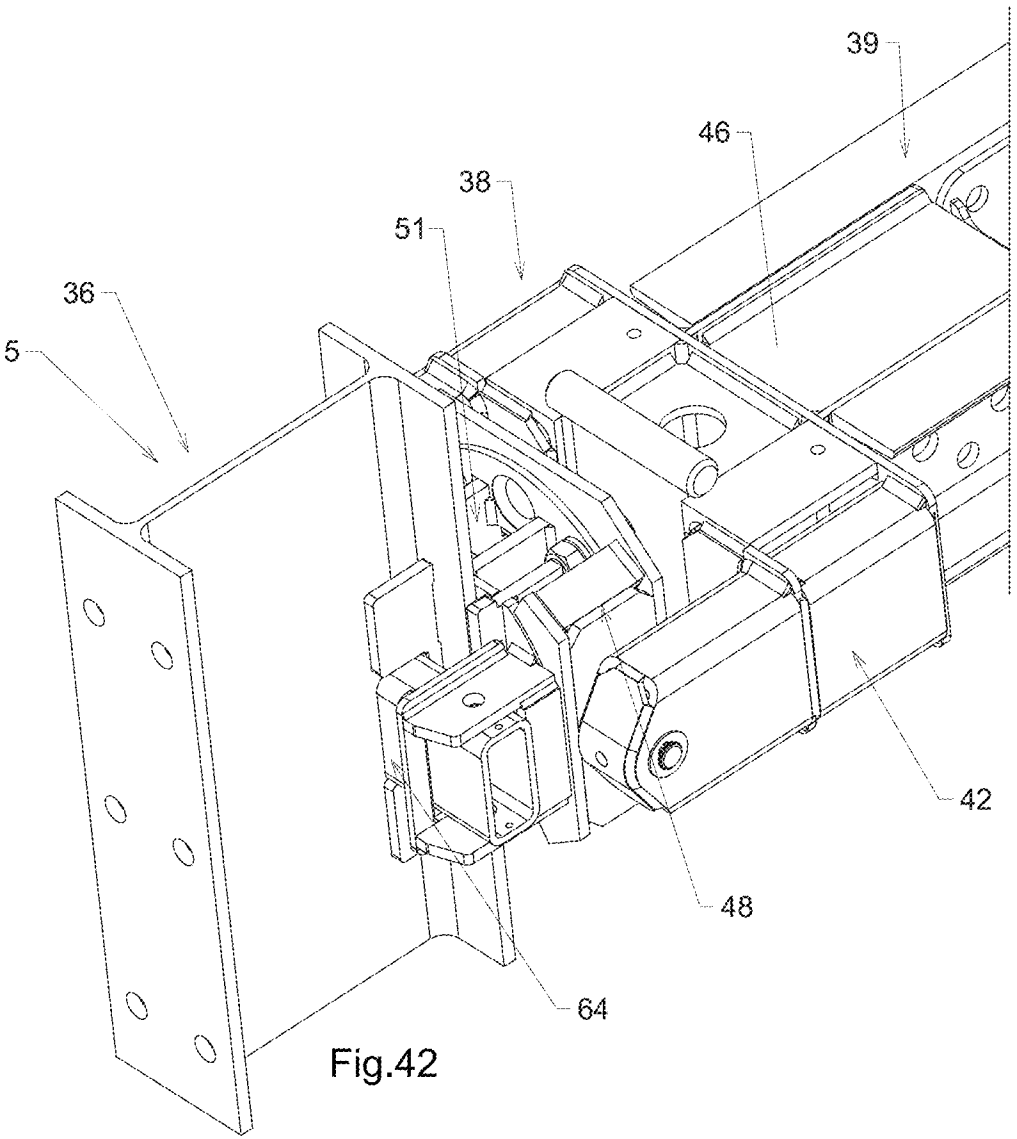
FIG. 42 is a detailed side perspective view of the climbing shoe of FIG. 41 in a position supporting the climbing rail.
Figure 44:
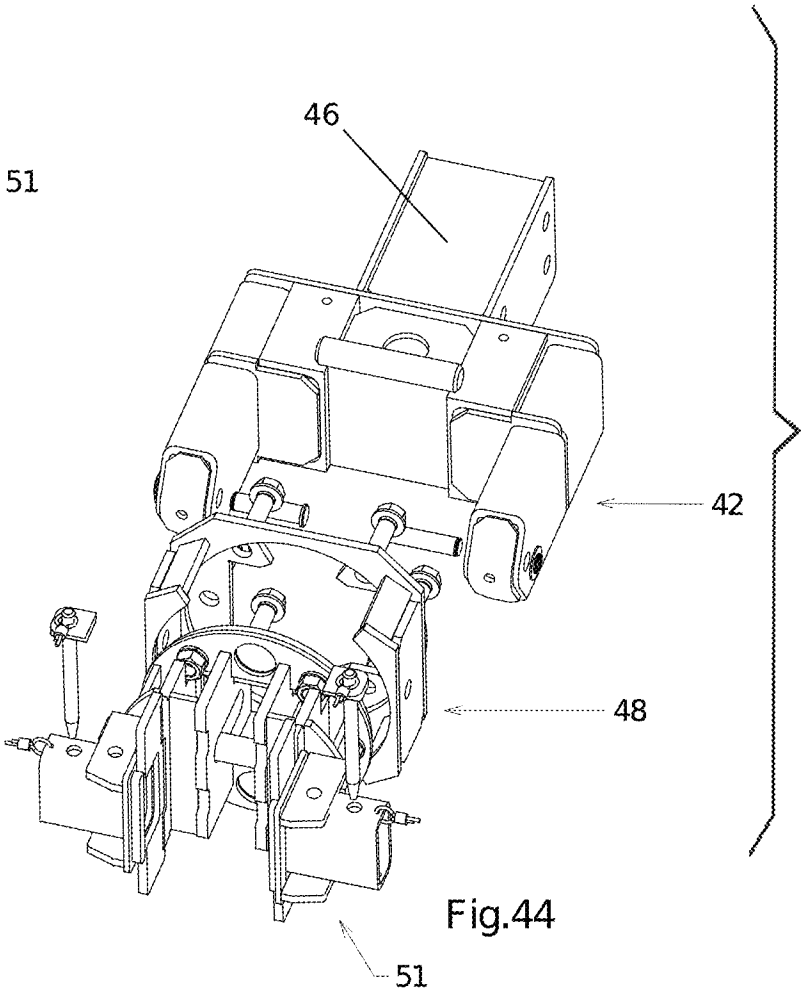
FIG. 44 is an exploded front perspective view.
Figure 43:
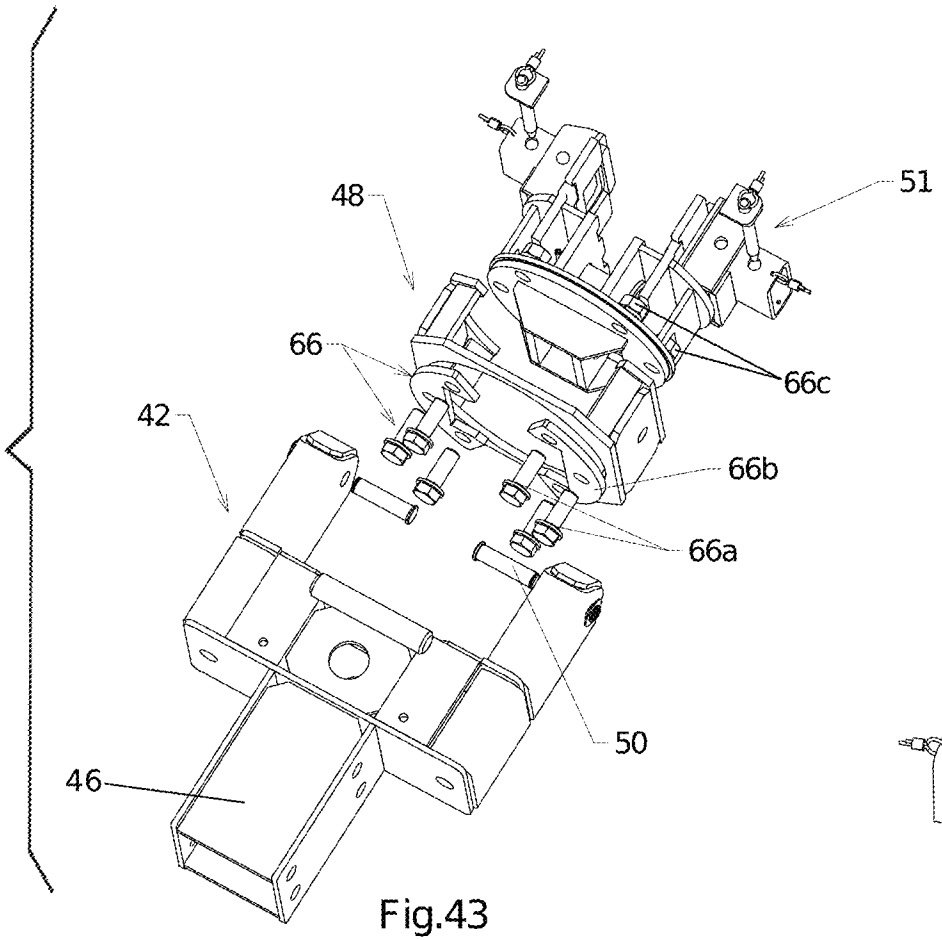
FIG. 43 is an exploded rear perspective view.
Figure 45:
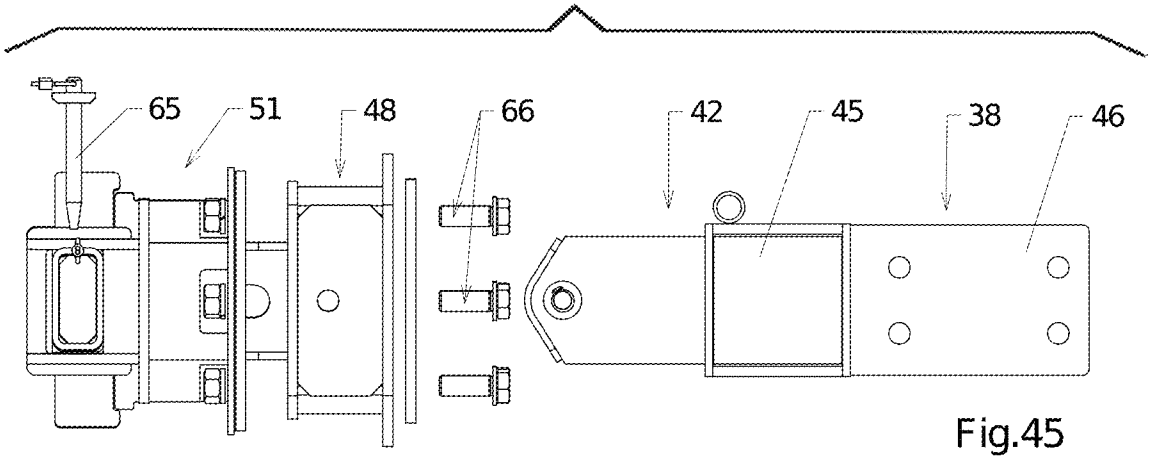
FIG. 45 is an exploded side plan view.
Figure 46:
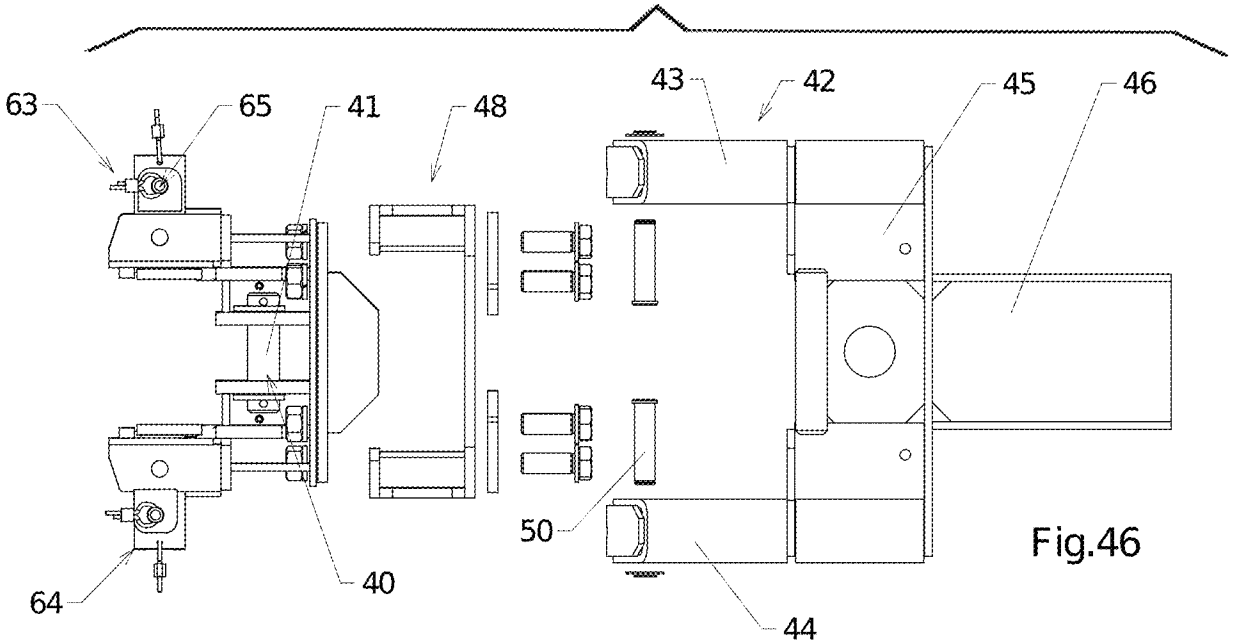
FIG. 46 is an exploded top plan view of the climbing shoe of FIG. 42.
Figure 49:
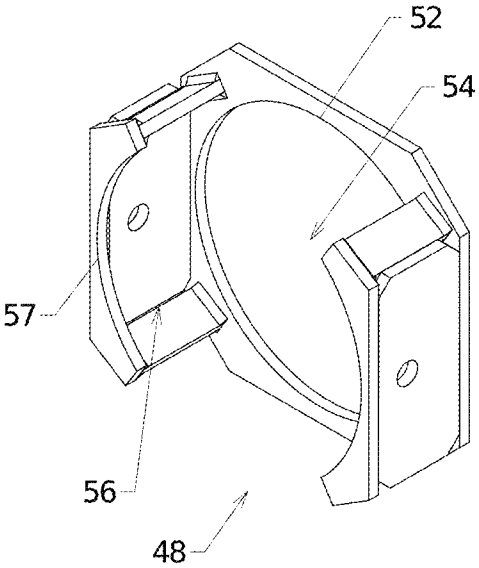
FIG. 49 is a partial perspective view of an outer member of the climbing shoe of FIG. 44.
Figure 48:
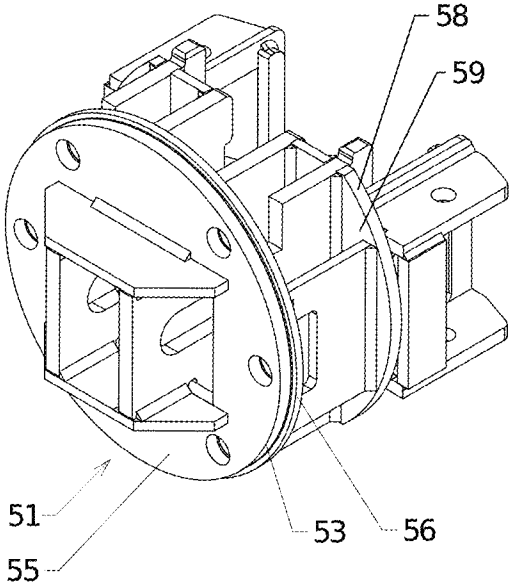
FIG. 47 and FIG. 48 are partial perspective views of an inner member of the climbing shoe of FIGS. 43 and 44.
Figure 47:
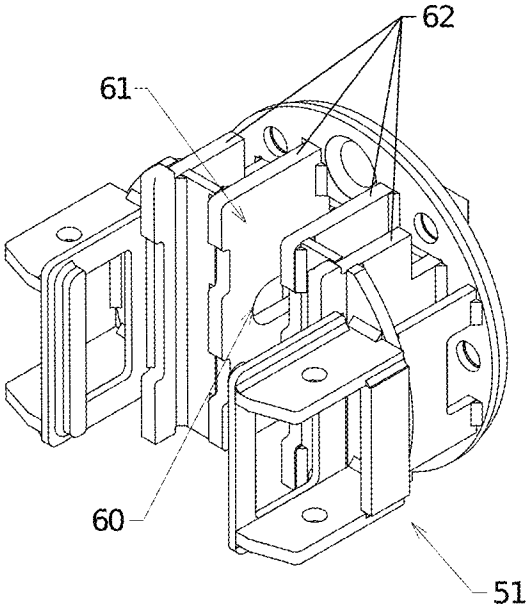
Figure 53:
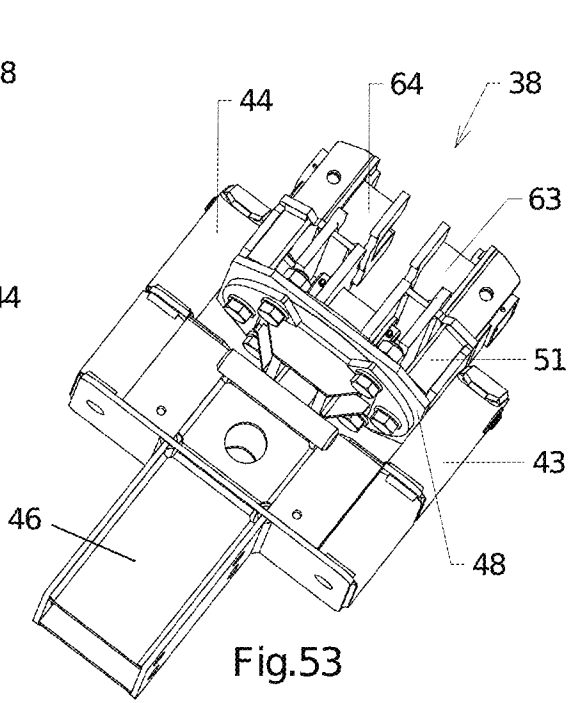
FIG. 53 is a 180° rotated side perspective view of the climbing shoe of FIG. 44.
Figure 52:
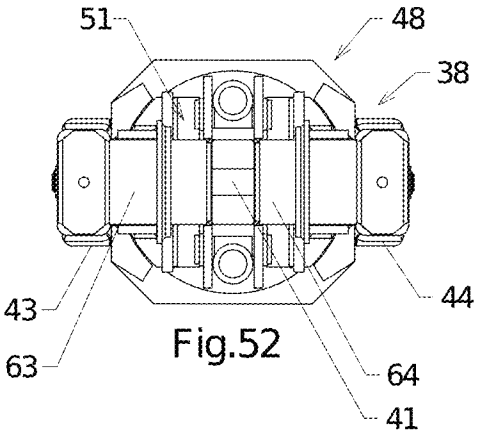
FIG. 52 is an end plan view of the climbing shoe shown in FIG. 44.
Figure 54:
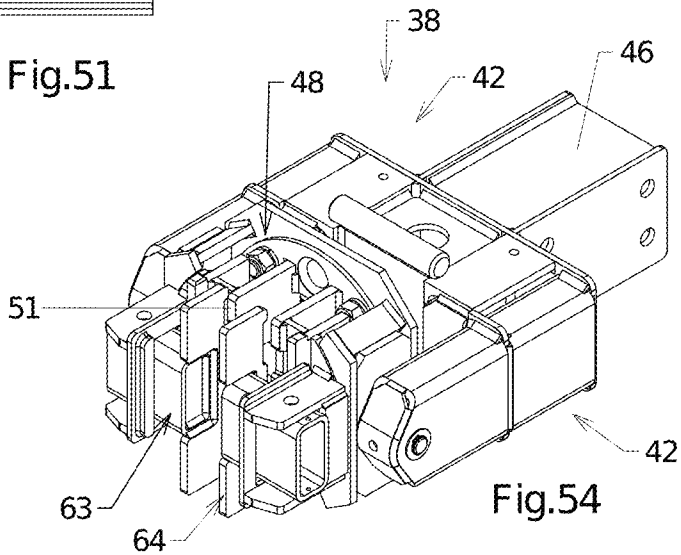
FIG. 54 is a side perspective view of the climbing shoe of FIG. 44 with locking and guiding members arranged in an inner position for locking and guiding the climbing rail (not shown here).
Figure 50:
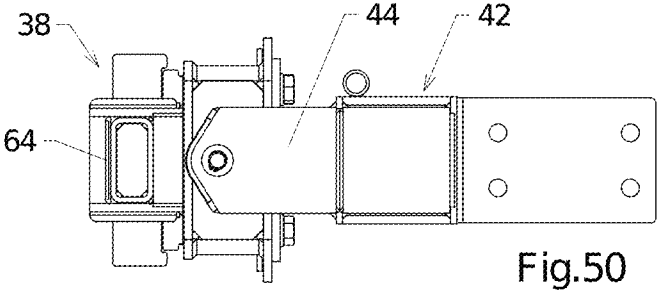
FIG. 50 is a side plan view of the climbing shoe of FIG. 45.
Figure 51:
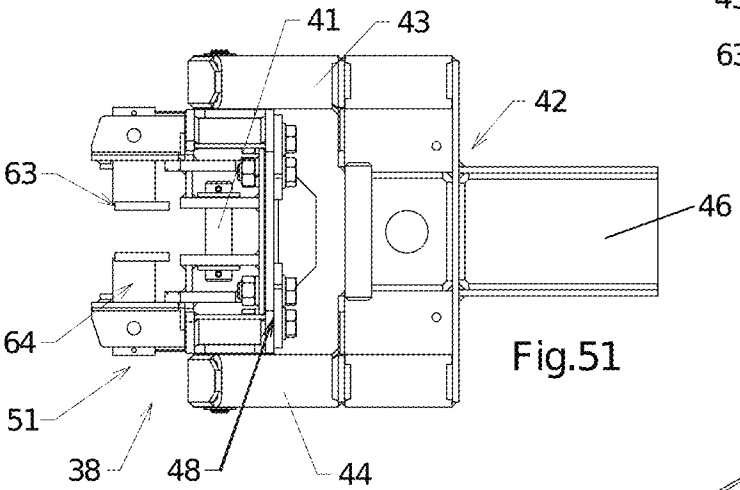
FIG. 51 is a top plan view of the climbing shoe of FIG. 46.

In the initial shown example, the second lateral platform part 35*c* may be pivoted about a pivot axis 35*d* extending perpendicularly to the main plane of the screen member 4 into an inclined position shown with dashed lines in FIG. 34, FIG. 36 and FIG. 38 to remain in a horizontal position (parallel to the middle platform part 35*a*) when the longitudinal carriers 5 and thus the lateral screen members 12 are tilted sideward.

In the initial shown example, the longitudinal carriers 5 are climbing rails 36 having a double-T-profile with vertically spaced engaging members 37, in particular hooks, for engaging climbing shoes 38 fixed on the floor 2 adjacent to the floor edge 2*a*. The climbing shoes 38 are mounted on longitudinal support arms 39 that preferably extend perpendicularly to the floor edge 2*a*.

In the initial shown example, the safety screen 1 is supported on a single floor 2 by means of a pair of climbing shoes 38 (i.e. floor supports and guides) and the first pair 31 and second pair 32 of anchoring bars 30.

In the initial shown example, the climbing shoes 38 are adapted for allowing a backward, forward and sideward tilting of the safety screen 1 so that the safety screen 1 can be arranged in all of the first, second, third, fourth, fifth and sixth operating positions.

In the initial shown example, the climbing shoe 38 comprises a support member 40 for releasably engaging the climbing rail 36. In the initial shown example, the support member 40 has a pin 41 for supporting one of the hooks 37 thereon. The climbing shoe 38 further comprises a fork member 42 with a first flange 43 and a second flange 44 spaced from one another in transverse direction. The first flange 43 and the second flange 44 project longitudinally from a transverse connecting arm 45, which has a central mount 46 for connection with the support arm 39. The support arm 39 preferably extends longitudinally in direction perpendicular to the floor edge 2*a*. In the initial shown example, more than one, for example three, connections 47 spaced longitudinally attach the support arm 39 to the floor 2.

In the initial shown example, the climbing shoe 38 comprises an outer member 48 pivotally connected to first flange 43 and second flange 44 about a transverse axis 49*a* extending parallel to the floor edge 2*a*. In the initial shown example, transverse axis 49*a* is defined by two pivot pins 50 extending perpendicularly to the first flange 43 and second flange 44, respectively. The transverse axis 49*a* allows the safety screen 1 to be pivoted backwards and forwards. The climbing shoe 38 further comprises an inner member 51 pivotally connected to the outer member 48 about a longitudinal axis 49*b* (extending perpendicularly to the screening surface 1*a* in the first operating position) so that the inner member 51 is tiltable sideward in both directions relative to the outer member 48.

In the initial shown example, the outer member 48 can be pivoted about the transverse axis 49*a* by at least 30 degrees backwards and forwards with respect to a central position of the outer member 48 corresponding to the first operating position. The inner member 51 can be pivoted about the longitudinal axis 49*b* by at least 30 degrees in both directions with respect to a central position of the inner member 48 (corresponding to the first operating position) independently of the backward or forward tilt of the outer member 48.

In the initial shown example, the outer member 48 has a first (inner) sliding support surface 52 and the inner member 51 has a corresponding first (outer) sliding surface 53. The first sliding surface 53 of the inner member 52 glides on the first sliding support surface 52 of the outer member 48 when adjusting the sideward tilt of the safety screen 1. Thus, the inner member 51 pivots about a virtual longitudinal axis defined by the concentric arrangement of the first sliding support surface 52 of the outer member 48 and the first sliding surface 53 of the inner member 51.

In the initial shown example, the first sliding support surface 52 of the outer member 48 and the first sliding surface 53 of the inner member 51 are circular in cross-section (perpendicular to the longitudinal axis 49*b* in the first operating position). The outer member 48 has a first circular through opening 54, the circumference of which defining the first sliding support surface 52. Preferably, a ratio between a diameter of the first circular opening 54 and an extension of the first sliding support surface 52 in direction of the longitudinal axis 49*b* is more than 3:1, in particular more than 5:1. The inner member 51 has a first circular disk 55 with a shape accurately fitting into the first circular opening 54 of the outer member 48. However, the first circular disk 55 may have an extension in direction of the longitudinal axis 49*b* that is slightly larger than that of the circular opening 54 to ensure rotatability of the inner member 51 against the outer member 48. Furthermore, the inner member 51 has an offset rim 56 adjacent the first disk 55, the offset rim 56 extending outwardly in radial direction from the adjacent first sliding surface 53 of the inner member 51.

In the initial shown example, the outer member 48 has a second circular opening 56 which is spaced from the first circular opening 54 in direction of the longitudinal axis 49*b*. The second circular opening 56 delimits a second sliding support surface 57 for a sliding support of a second sliding surface 58 of the inner member 51. The inner member 51 has a second disk 59 accurately fitting into the second circular opening 56 of the outer member 48. The second disk 59 has a vertically extending aperture 60 for allowing the introduction of the engagement member 37 of the climbing rail 36 into a space 61 between the first disk 55 and the second disk 59. The first disk 55 and the second disk 59 are connected by a plurality of webs 62.

In the initial shown example, the support member 40 is moveably mounted on the inner member 51 by means of a guide. In this way, the support member 40 can be transferred from a support position for supporting the engagement member 37 of the climbing rail 36 and a retracted position for allowing the climbing rail 36 to be moved upwards. In particular, the engagement members 37 may temporarily push the support member 40 to the retracted position when the climbing rail 36 is moved upwards. The support member 40 may have a spring (not shown) for biasing the pin 41 in direction of the support position so that the engagement member 36 is automatically supported on the pin 41 after completion of the upwards movement of the climbing rail 36.

In the initial shown example, the pin 41 is colinear with the transverse axis 49*a* and symmetrically arranged about a vertical plane extending centrally between the first flange 43 and the second flange 44 of the fork member 42.

In the initial shown example, a first locking and guiding member 63 and a second locking and guiding member 64 are connected to the inner member 51. The first locking and guiding member 63 and the second locking and guiding member 64 are moveable in direction of the transverse axis 49*a* between an outer position for inserting the climbing rail 36 into the climbing shoe 38 and an inner position for locking the climbing rail 36 to the climbing shoe 38 and for guiding the climbing rail 36 inside the climbing shoe 38. Safety pins 65 are provided for locking the first locking and guiding member 63 and the second locking and guiding member 64 in the support position and/or in the retracted position.

In the initial shown example, attachment members 66 are provided to axially secure the inner member 51 to the outer member 48. The attachment members 66 may comprise screws 66*a*, washers 66*b* and nuts 66*c*.

In the initial shown example, movement of the climbing rail 36 in direction of the transverse axis 49*a* is restricted by first guiding surfaces of the inner member 51 of the climbing shoe 38. In the same fashion, movement of the climbing rail 36 in direction of the longitudinal axis 49*b* is restricted by second guiding surfaces of the first locking and guiding member 63, second locking and guiding member 64 and inner member 51 of climbing shoe 38. For allowing the upward translation of the climbing rail 36, the climbing rail 36 is connected to the climbing shoe 38 with a first clearance in direction of the transverse axis 49*a* and a second clearance in direction of the longitudinal axis 49*b*. Preferably, a first ratio between a height (vertical extension) of the first guiding surfaces at the inner member 51 and the first clearance is at least 50:1, more preferably at least 100:1. Likewise, it is preferred that a second ratio between a height (vertical extension) of the second guiding surfaces at the first locking and guiding member 63, second locking and guiding member 64 and inner member 51 and the second clearance is at least 50:1, more preferably at least 100:1. For example, the height of the first and/or second guiding surfaces at the first locking and guiding member 63, second locking and guiding member 64 and inner member 51 may be at least 150 mm, preferably more than 180 mm, e.g. 200 mm. This construction ensures that the climbing rail 36, for example a front flange of a twin flanged climbing rail, is securely translated upwards inside the climbing shoe 38 without risk of jamming independently of the sideward and backward/forward tilt of the inner member 51 of climbing shoe 38.

The invention claimed is:

1. A climbing shoe for a climbing safety screen, comprising:

a support member for coupling a climbing rail of the climbing safety screen;

a fork member with a first flange and a second flange;

an outer member pivotally connected to the first flange and the second flange about a transverse axis; and an inner member mounted to the outer member and pivotable about a longitudinal axis with respect to the outer member, wherein the outer member has a first sliding support surface and the inner member has a first sliding surface, the first sliding support surface of the outer member being arranged for a sliding support of the first sliding surface of the inner member; and wherein the first sliding support surface of the outer member and the first sliding surface of the inner member are circular in cross-section.

2. The climbing shoe according to claim 1, wherein the outer member has a first circular opening defining the first sliding support surface.

3. The climbing shoe according to claim 2, wherein the inner member has a first disk fitting into the first circular opening of the outer member.

4. The climbing shoe according to claim 3, wherein the inner member has an offset rim adjacent the first disk, the offset rim overlapping in radial direction with the outer member.

5. The climbing shoe according to claim 2, wherein the outer member has a second circular opening spaced from the first circular opening, the second circular opening defining a second sliding support surface of the outer member for a sliding support of a second sliding surface of the inner member.

6. The climbing shoe according to claim 5, wherein the inner member has a second disk fitting into the second circular opening of the outer member.

7. The climbing shoe according to claim 6, wherein the second disk has an aperture for allowing the introduction of an engagement member of the climbing rail into a space between a first disk and the second disk of the inner member.

8. The climbing shoe according to claim 7, wherein the first disk and the second disk are connected by at least two webs.

9. The climbing shoe according to claim 1, wherein the support member is displaceably mounted on the inner member.

10. The climbing shoe according to claim 9, wherein the support member has a pin which is arranged colinear with the transverse axis.

11. The climbing shoe according to claim 1, wherein the support member is symmetrically arranged about a vertical plane containing the longitudinal axis.

12. The climbing shoe according to claim 1, wherein a first locking and guiding member and a second locking and guiding member are mounted to the inner member, the first locking and guiding member and the second locking and guiding member being moveable between an outer position for inserting the climbing rail into the climbing shoe and an inner position for locking the climbing rail to the climbing shoe.

13. The climbing shoe according to claim 1, wherein the outer member can be pivoted about the transverse axis by at least 20 degrees backwards and forwards with respect to a central position of the outer member.

14. The climbing shoe according to claim 1, wherein the inner member can be pivoted about the longitudinal axis by at least 20 degrees in both directions with respect to a central position of the inner member.

15. A climbing screen support system comprising the climbing shoe according to claim 1, the climbing screen support system comprising:

a support arm fixable to a surface adjacent an edge of a floor, wherein the climbing shoe is connected to an end of the support arm.

16. A climbing screen system comprising the climbing screen support system according to claim 15, the climbing screen system comprising:

a climbing safety screen with a climbing rail having an engagement member supported on the support member of the climbing shoe.

* * * * *